US009365386B2

(12) United States Patent
Ando et al.

(10) Patent No.: US 9,365,386 B2
(45) Date of Patent: Jun. 14, 2016

(54) SHEET PROCESSING APPARATUS THAT PERFORMS POST-PROCESSING, AND IMAGE FORMING SYSTEM HAVING THE SAME

(71) Applicant: CANON KABUSHIKI KAISHA, Tokyo (JP)

(72) Inventors: Yutaka Ando, Toride (JP); Mitsuhiko Sato, Kashiwa (JP); Akihiro Arai, Toride (JP); Hiromasa Maenishi, Matsudo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/310,789

(22) Filed: Jun. 20, 2014

(65) Prior Publication Data

US 2015/0024916 A1 Jan. 22, 2015

(30) Foreign Application Priority Data

Jul. 18, 2013 (JP) ..... 2013-149327

(51) Int. Cl.

| | |
|---|---|
| ***B65H 45/12*** | (2006.01) |
| ***B65H 43/06*** | (2006.01) |
| ***B65H 45/04*** | (2006.01) |
| ***B65H 39/00*** | (2006.01) |
| ***B31F 1/00*** | (2006.01) |
| ***B65H 45/18*** | (2006.01) |

(52) U.S. Cl.

CPC ..... *B65H 45/12* (2013.01); *B31F 1/0006* (2013.01); *B31F 1/0035* (2013.01); *B65H 39/00* (2013.01); *B65H 43/06* (2013.01); *B65H 45/04* (2013.01); *B65H 45/18* (2013.01); *B65H 2301/51232* (2013.01); *B65H 2511/13* (2013.01); *B65H 2701/13212* (2013.01)

(58) Field of Classification Search

CPC ..... B31F 1/0006; B31F 1/0035; B65H 43/06; B65H 45/04; B65H 45/12; B65H 39/00; B65H 2801/27

USPC ..... 270/32, 45, 58.07, 58.09; 493/25, 28, 493/405

See application file for complete search history.

(56) References Cited

U.S. PATENT DOCUMENTS

| | | | | |
|---|---|---|---|---|
| 6,692,208 | B1 * | 2/2004 | Watkiss et al. | 412/1 |
| 8,083,218 | B2 * | 12/2011 | Dobashi et al. | 270/45 |
| 8,191,882 | B2 * | 6/2012 | Kikkawa et al. | 270/45 |

(Continued)

FOREIGN PATENT DOCUMENTS

JP 62-016987 A 1/1987

*Primary Examiner* — Leslie A Nicholson, III

(74) *Attorney, Agent, or Firm* — Rossi, Kimms & McDowell LLP

(57) ABSTRACT

A sheet processing apparatus capable of determining whether or not a press operation is to be performed on a folded part of a sheet bundle according to the number of sheets of the sheet bundle. If a folding priority mode is not set on a selection screen displayed on a display unit of the sheet processing apparatus, a controller of the sheet processing apparatus determines whether or not the number of sheets of the sheet bundle indicated in sheet bundle information is equal to or larger than a threshold value. The controller sets a press mode in the sheet bundle information to "press," if the number of sheets of the sheet bundle is equal to or larger than the threshold value, and sets the press mode to "pressless," if the number of sheets of the sheet bundle is less than the threshold value.

11 Claims, 21 Drawing Sheets

(56) References Cited

U.S. PATENT DOCUMENTS 8,342,498 B2 * 1/2013 Urano ..... 270/45
8,439,341 B2 * 5/2013 Ishikawa et al. ..... 270/45
8,505,900 B2 * 8/2013 Urano ..... 270/45
8,613,435 B2 * 12/2013 Kato et al. ..... 270/45

* cited by examiner

*FIG. 2A*

J1

| SHEET ID |
| --- |
| SHEET WIDTH (mm) |
| SHEET LENGTH (mm) |
| BASIS WEIGHT (g/m$^2$) |
| POST-PROCESSING MODE |
| STANDARD SHEET INTERVAL TIME (msec) |
| FOLDING MODE |
| ⋮ |

*FIG. 2B*

J2

| SHEET ID |
| --- |
| REQUIRED SHEET INTERVAL TIME (msec) |

*FIG. 10*

J3

| |
|---|
| BUNDLE ID |
| NUMBER OF SHEETS OF SHEET BUNDLE |
| SHEET WIDTH (mm) |
| SHEET LENGTH (mm) |
| BASIS WEIGHT ($g/m^2$) |
| PRESS MODE |

FIG. 15

TBL1

| PRESS MODE | SHEET SIZE | NUMBER OF SHEETS OF SHEET BUNDLE 1-5 | 6-10 | 11-15 | 16-20 | 21-25 |
|---|---|---|---|---|---|---|
| PRESSLESS | EQUAL TO OR LESS THAN 297 mm IN SHEET LENGTH AND EQUAL TO OR LESS THAN 216 mm IN SHEET WIDTH | 3700 | 3700 | 3700 | 3700 | 3700 |
| | LARGER THAN 297 mm AND EQUAL TO OR LESS THAN 420 mm IN SHEET LENGTH AND LARGER THAN 216 mm AND EQUAL TO OR LESS THAN 297 mm IN SHEET WIDTH | 5700 | 5700 | 5700 | 5700 | 5700 |
| | LARGER THAN 420 mm IN SHEET LENGTH AND LARGER THAN 297 mm IN SHEET WIDTH | 5900 | 7200 | 8700 | 16200 | 21200 |
| PRESS | EQUAL TO OR LESS THAN 297 mm IN SHEET LENGTH AND EQUAL TO OR LESS THAN 216 mm IN SHEET WIDTH | 4500 | 5500 | 7000 | 9700 | 14000 |
| | LARGER THAN 297 mm AND EQUAL TO OR LESS THAN 420 mm IN SHEET LENGTH AND LARGER THAN 216 mm AND EQUAL TO OR LESS THAN 297 mm IN SHEET WIDTH | 6500 | 7500 | 9000 | 16000 | 20000 |
| | LARGER THAN 420 mm IN SHEET LENGTH AND LARGER THAN 297 mm IN SHEET WIDTH | 6700 | 8000 | 9500 | 17000 | 22000 |
| FLATTENING | EQUAL TO OR LESS THAN 297 mm IN SHEET LENGTH AND EQUAL TO OR LESS THAN 216 mm IN SHEET WIDTH | 5500 | 6500 | 8000 | 10700 | 15000 |
| | LARGER THAN 297 mm AND EQUAL TO OR LESS THAN 420 mm IN SHEET LENGTH AND LARGER THAN 216 mm AND EQUAL TO OR LESS THAN 297 mm IN SHEET WIDTH | 7500 | 8500 | 10000 | 17000 | 21000 |
| | LARGER THAN 420 mm IN SHEET LENGTH AND LARGER THAN 297 mm IN SHEET WIDTH | 7700 | 9000 | 10500 | 18000 | 23000 |

FIG. 17

TBL2

| SHEET LENGTH / SHEET WIDTH | EQUAL TO OR LESS THAN 297 mm | LARGER THAN 297 mm AND EQUAL TO OR LESS THAN 364 mm | LARGER THAN 364 mm AND EQUAL TO OR LESS THAN 420 mm | LARGER THAN 420 mm |
|---|---|---|---|---|
| EQUAL TO OR LESS THAN 216 mm | 5 | 4 | 4 | 4 |
| LARGER THAN 216 mm AND EQUAL TO OR LESS THAN 257 mm | 4 | 4 | 4 | 4 |
| LARGER THAN 257 mm AND EQUAL TO OR LESS THAN 297 mm | 4 | 4 | 4 | 3 |
| LARGER THAN 297 mm | 4 | 4 | 3 | 2 |

SHEET PROCESSING APPARATUS THAT PERFORMS POST-PROCESSING, AND IMAGE FORMING SYSTEM HAVING THE SAME

BACKGROUND OF THE INVENTION

1. Field of the Invention

The present invention relates to a sheet processing apparatus that performs post-processing on sheets formed with images, and relates to an image forming system having the sheet processing apparatus.

2. Description of the Related Art

Heretofore there have been widely known sheet processing apparatuses that perform post-processing such as folding on sheets output from an image forming apparatus such as a copying machine or a printer. Sheet processing apparatuses have become more multifunctional in recent years. Some of them have an end stitching function to stitch a sheet bundle at its end, a saddle stitching function to stitch a sheet bundle at its center, and a bookbinding function to perform bookbinding by folding a saddle-stitched sheet bundle at its saddle-stitched part.

In Japanese Laid-open Patent Publication No. 62-16987, a sheet folding apparatus has been proposed in which a bundle of sheets fed from a copying machine is inserted into between a roller pair and thereby folded into two, and only a folded part of the sheet bundle is pressed by moving an additionally folding roller (press roller), with the folded part held between the roller pair, whereby the sharpness of the folded part is ensured.

When enhanced folding is performed on a sheet bundle as described above, stacking of sheets on a sheet stacking tray, folding of the sheet bundle conveyed from the tray, and pressing of the folded part of the sheet bundle are sequentially performed. To improve the productivity, the folding of the sheet bundle is sometimes performed concurrently with the staking of the next sheet bundle on the sheet stacking tray.

However, if the number of sheets that constitute a sheet bundle following a sheet bundle to be processed is small and a time required to stack the next sheet bundle is short, a time required to perform the press operation on the sheet bundle to be processed is longer than the time required to stack the next sheet bundle. In that case, an operation for folding the next sheet bundle cannot be started until the press operation of the sheet bundle to be processed is completed. It is therefore necessary for the next sheet bundle to wait on the sheet stacking tray, and the productivity is lowered accordingly.

SUMMARY OF THE INVENTION

The present invention provides a sheet processing apparatus capable of determining whether or not a press operation is to be performed on a folded part of a sheet bundle according to the number of sheets of the sheet bundle, and provides an image forming system having the sheet processing apparatus.

According to one aspect of this invention, there is provided a sheet processing apparatus comprising a stacking unit configured to stack sheets thereon to form a sheet bundle, a folding unit configured to fold the sheet bundle formed by the stacking unit, a press unit configured to perform press processing to press a folded part of the sheet bundle folded by the folding unit, a setting unit configured to set an operation mode of the press unit, and a control unit configured, in a case where the operation mode of the press unit is set to a predetermined mode by said setting unit, to control the press unit to perform the press processing on the folded sheet bundle, and configured, in a case where the operation mode of the press unit is set to a mode other than the predetermined mode by the setting unit, to determine based on the number of sheets of the sheet bundle whether the press processing is to be performed on the sheet bundle and control the press unit accordingly.

With this invention, whether or not a press operation is to be performed on a folded part of a sheet bundle can be determined according to the number of sheets of the sheet bundle, whereby productivity can be improved.

Further features of the present invention will become apparent from the following description of exemplary embodiments (with reference to the attached drawings).

BRIEF DESCRIPTION OF THE DRAWINGS

FIG. 2A is a view showing a format of sheet information transmitted from an image forming apparatus to a finisher;

FIG. 2B is a view showing a format of sheet interval information transmitted from the finisher to the image forming apparatus;

FIG. 10 is a view showing a format of sheet bundle information which is referred to by a CPU of the finisher;

FIG. 15 is a view showing a book-bind processing time table used in step S312 of FIG. 13B to obtain book-bind processing time;

FIG. 17 is a view showing an example of a threshold value table created in the threshold value setting process of FIG. 16.

DESCRIPTION OF THE EMBODIMENTS

The present invention will now be described in detail below with reference to the drawings showing preferred embodiments thereof.

Figure 1:
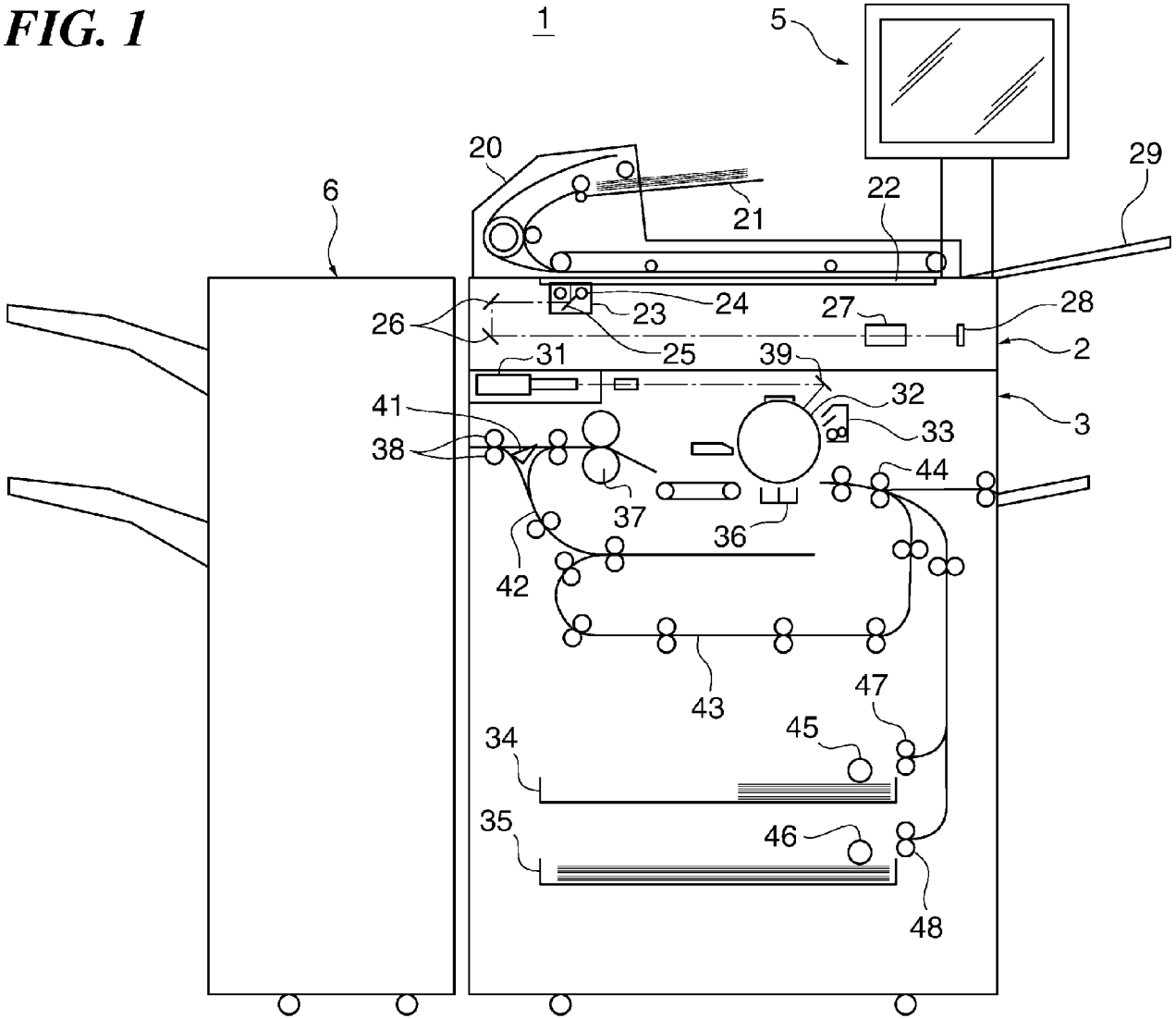
FIG. 1 is a view schematically showing the construction of an image forming system.

FIG. 1 schematically shows an image forming system that includes a sheet processing apparatus according to one embodiment of this invention. The image forming system includes an image forming apparatus 1 and a finisher 6 that serves as the sheet processing apparatus.

The image forming apparatus 1 includes an image reader 2 that reads an image from a document, a printer 3 that forms a read image on a sheet, and an operation display apparatus 5.

The image reader 2 has a document feeder 20 with which documents set upward on a document tray 21 are fed one by one. The fed document is conveyed along a curved path and a platen glass 22, and discharged toward an external sheet discharge tray 29.

When a document passes through a reading position on the platen glass 22, an image of the document is read by a scanner unit 23 held at a position corresponding to the reading position. More specifically, when the document passes through the reading position, a read surface of the document is irradiated by light from a lamp 24 of the scanner unit 23, and light reflected from the document is introduced into a lens 27 via mirrors 25, 26. An image of light passing through the lens 27 is formed on an imaging face of an image sensor 28, is converted into image data by the image sensor 28, and is output as a video signal to an exposure unit 31 of the printer 3.

The exposure unit 31 modulates laser light according to the video signal supplied from the image reader 2, and outputs the modulated laser light. The laser light is irradiated onto a photosensitive drum 32, while being scanned by a polygon mirror 39, whereby an electrostatic latent image is formed on the photosensitive drum 32 according to the laser light. The electrostatic latent image is developed into a developer image (toner image) by developer supplied from a developing device 33.

On the other hand, a sheet is fed from an upper cassette 34 or a lower cassette 35 of the printer 3 by a pickup roller 45 or 46, and is conveyed toward a registration roller 44 by a sheet feed roller 47 or 48. When a leading end of the sheet reaches the registration roller 44, sheet conveyance is temporarily stopped and sheet information is notified to the finisher 6 via a communication IC (not shown).

FIG. 2A shows a format of sheet information J1 transmitted from the image forming apparatus 1 to the finisher 6, and FIG. 2B shows a format of sheet interval information J2 transmitted from the finisher 6 to the image forming apparatus 1. The sheet information J1 includes information about sheet ID (specifying a corresponding sheet), sheet size (sheet width and sheet length), basis weight, post-processing mode, standard sheet interval time, folding mode, etc. The sheet interval information J2 includes information about sheet ID, required sheet interval time, etc.

As described in detail later, the image forming apparatus 1 of the image forming system of FIG. 1 is provided with a CPU circuit unit 90 having a CPU 90*a* (see FIG. 3), and the finisher 6 is provided with a finisher controller 96 having a CPU 100 (see, FIGS. 3 and 7). When receiving sheet information J1 from the image forming apparatus 1, the CPU 100 of the finisher 6 determines a time required for execution of post-processing by the CPU 100 based on sheet sizes and post-processing modes respectively associated with a sheet temporarily stopped at the position of the registration roller 44 and a preceding sheet conveyed immediately before the sheet temporarily stopped. Next, the CPU 100 determines a sheet interval (conveyance interval time) between these sheets, and notifies the image forming apparatus 1 of sheet interval information J2 that includes a required sheet interval time to which the determined sheet interval is reflected. The CPU 90*a* of the image forming apparatus 1 causes the sheet to stop at the registration roller 44 until lapse of the required sheet interval time indicated by the sheet interval information J2 received from the finisher 6, and then restarts the sheet conveyance.

In the image forming apparatus 1, the registration roller 44 is driven to convey the sheet to between the photosensitive drum 32 and the transfer device 36, and the toner image formed on the photosensitive drum 32 is transferred to the sheet by the transfer device 36. Next, the sheet is conveyed to the fixing device 37 in which the sheet is heated and pressurized to fix the toner image to the sheet. The sheet passing through the fixing device 37 passes through the flapper 41 and the discharge roller 38, and is discharged from the printer 3 to the finisher 6.

To discharge the sheet in a face-down state where the image-formed surface of the sheet is directed downward, the flapper 41 in the image forming apparatus 1 is switchingly operated to temporarily guide the sheet passing through the fixing device 37 into an inversion path 42. After the rear end of the sheet passes through the flapper 41, the sheet is switched back and discharged from the printer 3 to the finisher 6 by the discharge roller 38.

When double-sided recording to form images on both surfaces of the sheet is set, the flapper 41 in the image forming apparatus 1 is switchingly operated to guide the sheet into the inversion path 42. Then, the sheet is conveyed to a double-sided conveyance path 43 and refed from the conveyance path 43 into between the photosensitive drum 32 and the transfer device 36. The sheet formed at its both surfaces with images is discharged from the printer 3 to the finisher 6.

Next, a description will be given of the construction of the controller 9 that controls the entire image forming system. FIG. 3 schematically shows the construction of the controller 9 in block diagram.

Figure 3:
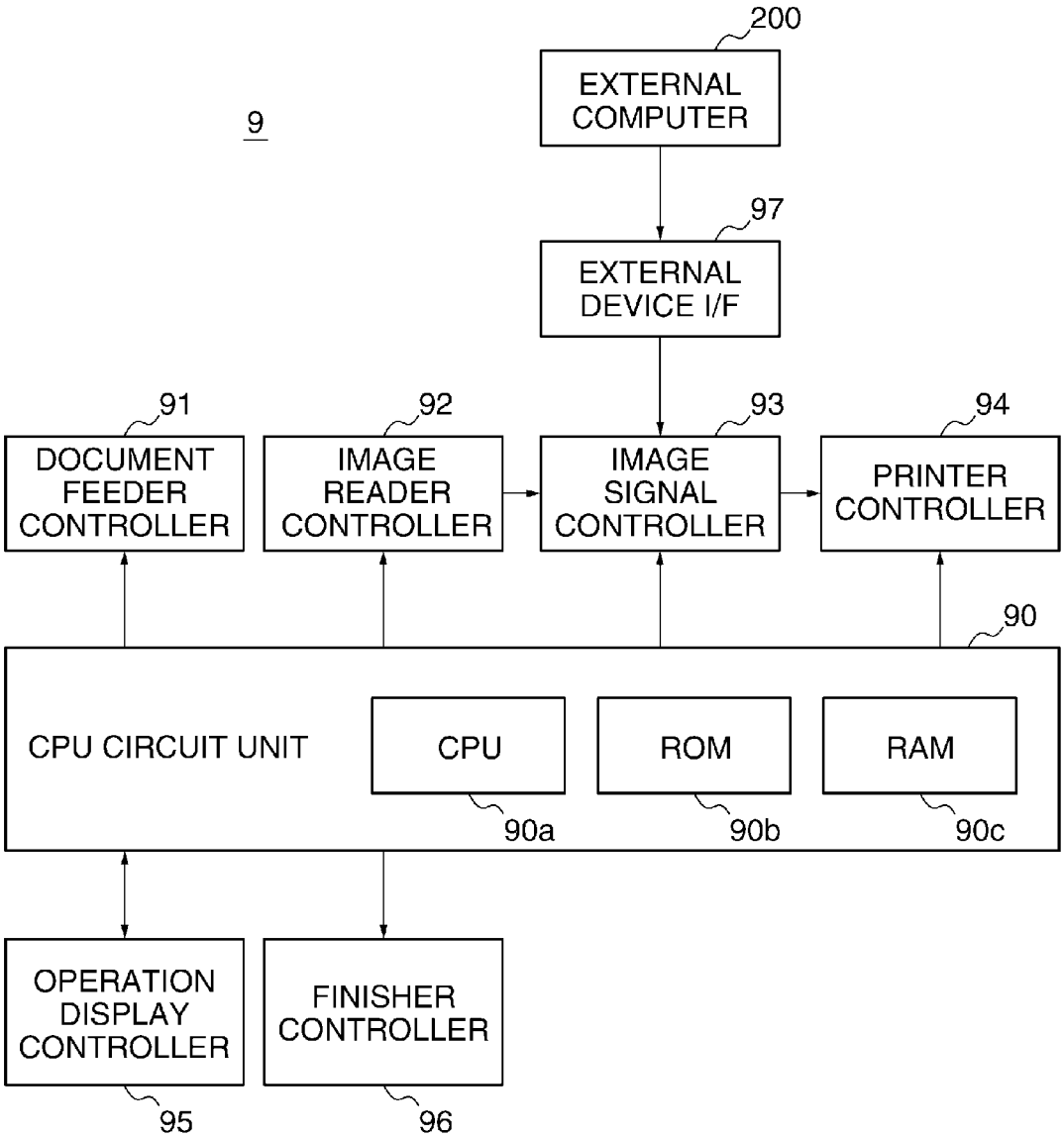
FIG. 3 is a block diagram schematically showing the construction of a controller of the image forming system.

As shown in FIG. 3, the controller 9 has a CPU circuit unit 90 in which a CPU 90*a*, a ROM 90*b*, and a RAM 90*c* are incorporated. The CPU 90*a*, which performs basic control of the entire image forming system, executes a control program stored in the ROM 90*b* to thereby totally controls controllers 91-96. The RAM 90*c* temporarily stores control data, and is used as work area for arithmetic processing during the control.

The document feeder controller 91 drives and controls the document feeder 20 according to an instruction from the CPU circuit unit 90. The image reader controller 92 drives and controls the scanner unit 23, the image sensor 28, etc., and transfers an image signal, which is output from the image sensor 28, to the image signal controller 93.

Under the control of the CPU circuit unit 90, the image signal controller 93 converts an analog image signal supplied from the image sensor 28 into a digital signal, performs various processing on the digital signal, and converts the processed signal into a video signal for output to the printer controller 94. Under the control of the CPU circuit unit 90, the image signal controller 93 performs various processing on a digital image signal supplied from the external computer 200 via an external device I/F 97, and converts the resultant signal into a video signal for output to the printer controller 94. The printer controller 94 controls the exposure unit 31 and the printer 3 according to the input video signal, thereby controlling image formation and sheet conveyance.

The image forming apparatus 1 and the finisher 6 are connected for communication to each other. The finisher controller 96 is mounted to the finisher 6, and drives and controls the entire finisher 6, while exchanging information with the CPU circuit unit 90 mounted on the image forming apparatus 1.

The operation display controller 95 exchanges information between the operation display apparatus 5 and the CPU circuit unit 90. The operation display apparatus 5 has keys for setting various functions associated with image formation, a display unit for displaying information representing a setting state, etc. The operation display apparatus 5 outputs key signals, which correspond to key operations, to the CPU circuit unit 90, and causes a display unit of the operation display apparatus 5 to display information according to a signal from the CPU circuit unit 90.

Figure 4A:
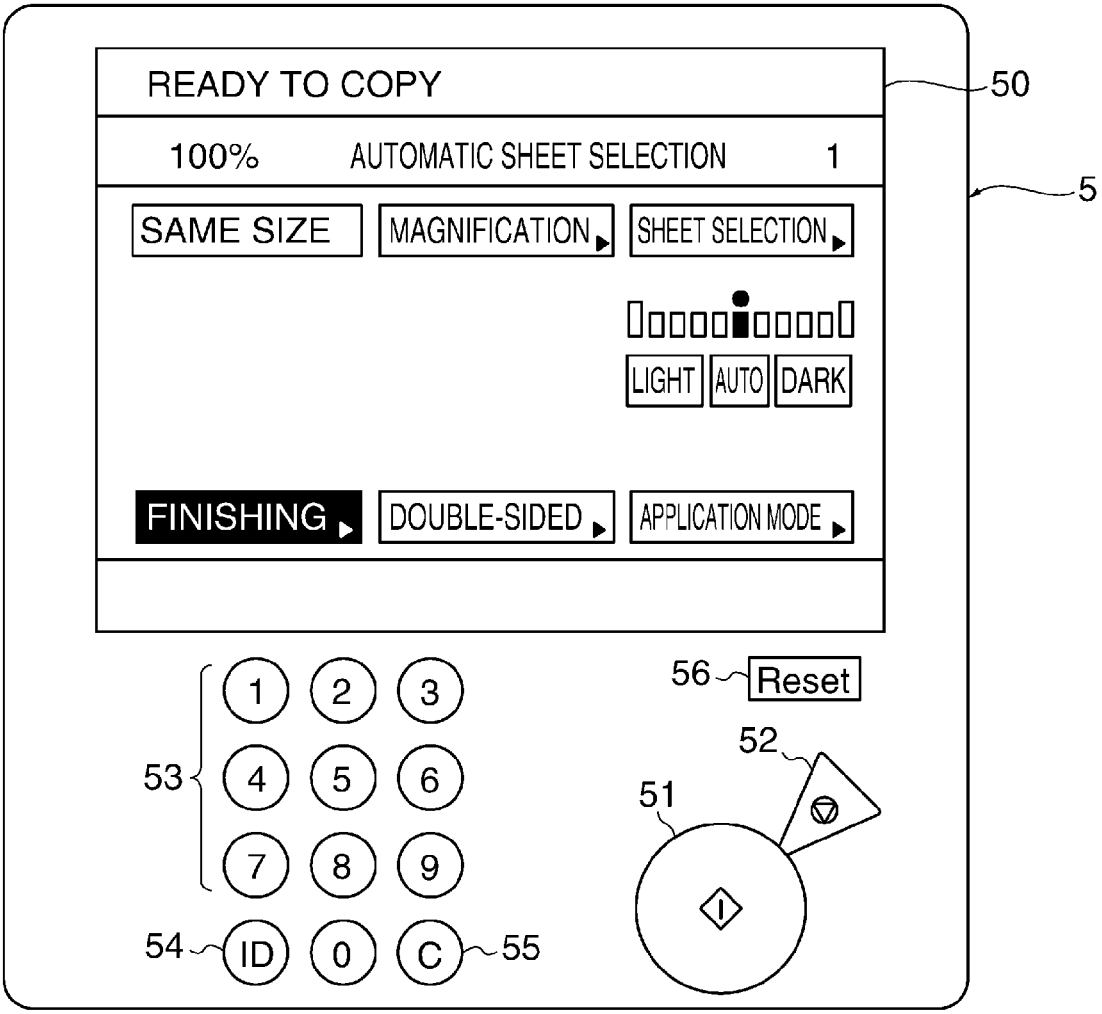
FIG. 4A is a view showing an operation display apparatus of the image forming apparatus.

FIG. 4A shows the operation display apparatus 5. The operation display apparatus 5 has a start key 51 for starting image forming operation, a stop key 52 for stopping image forming operation, ten keys 53 for entering settings, an ID key 54, a clear key 55, and a reset key 56. Furthermore, the operation display apparatus 5 has a display unit 50 provided with a touch panel display screen.

Figure 4B:
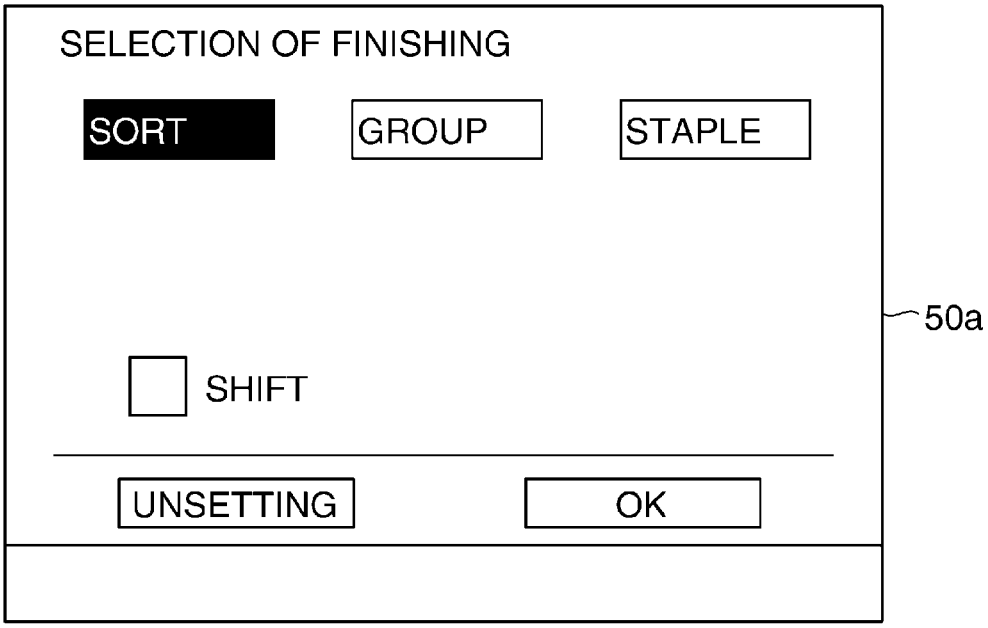
FIGS. 4B and 4C are views each showing an example of a selection screen displayed on a display screen of the operation display apparatus.
Figure 4C:
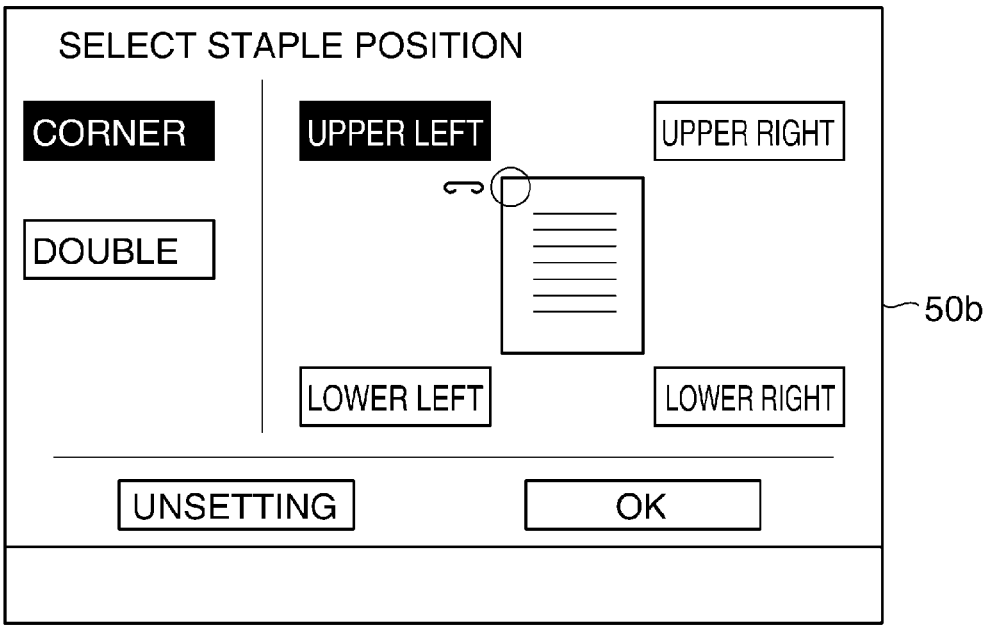

On the display screen of the display unit 50, there are displayed a finishing selection screen 50*a* (FIG. 4B), a staple position selection screen 50*b* (FIG. 4C), etc. The operation display apparatus 5 is used to set the post-processing mode of the image forming apparatus 1 such as non-sort, sort, staple sort (folding mode), or book-binding mode.

Figure 5:
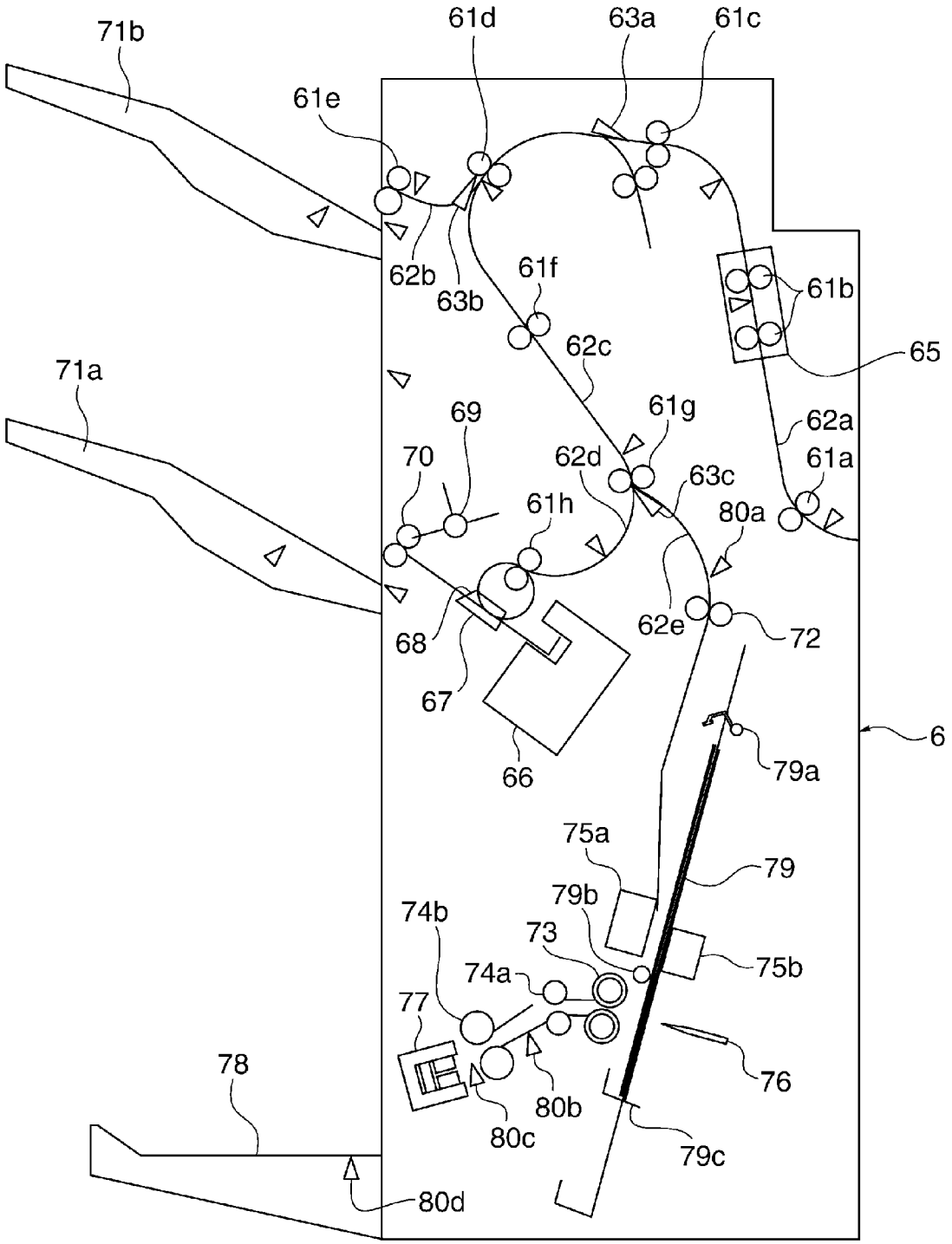
FIG. 5 is a view schematically showing the construction of the finisher.

Next, a description will be given of the construction of the finisher 6. FIG. 5 schematically shows the construction of the finisher 6. FIG. 7 shows the functional construction of the finisher 6 in block diagram.

The finisher 6 can perform post-processing such as processing for sequentially taking in sheets discharged from the image forming apparatus 1 and for aligning the taken-in sheets into a sheet bundle, staple processing for stapling a rear end of a sheet bundle by a staple, and bookbinding processing for folding a sheet bundle into two at the center (i.e., for center folding) and for saddle stitching the sheet bundle.

The finisher 6 includes conveyance roller pairs 61*a*-61*h*, paths 62*a*-62*e*, and changeover flappers 63*a*-63*c*. A sheet discharged from the image forming apparatus 1 is taken in the conveyance path 62*a* by the conveyance roller pair 61*a*, and a positional deviation of the sheet in a direction perpendicular to a sheet conveyance direction is corrected by a shift unit 65. Next, the sheet is conveyed toward the changeover flapper 63*a* by the conveyance roller pairs 61*b*, 61*c*, and conveyed by the conveyance roller pair 61*d* toward the changeover flapper 63*b*.

When a sheet conveyance destination is switched to the side of the upper sheet discharge path 62*b* by the changeover flapper 63*b*, the conveyance roller pair 61*d* is driven by a buffer motor M2 (FIG. 7) and the conveyance roller pair 61*e* is driven by a sheet discharge motor M3 (FIG. 7), whereby the sheet is discharged to a stacking tray 71*b* via the upper sheet discharge path 62*b*.

When the sheet conveyance destination is switched to the side of the lower conveyance path 62*c* by the changeover flapper 63*b*, the conveyance roller pair 61*d* is driven by the buffer motor M2 and the conveyance roller pair 61*f* is driven by the sheet discharge motor M3, whereby the sheet is guided to the changeover flapper 63*c* along the lower conveyance path 62*c*.

When the sheet conveyance destination is switched to the side of the lower sheet discharge path 62*d* by the changeover flapper 63*c*, the conveyance roller pairs 61*g*, 61*h* are driven by the sheet discharge motor M3, whereby the sheet is guided to a processing tray 67. Then, binding processing in which a rear end of a bundle of sheets stacked on the processing tray 67 is bound by a stapler 66 is performed, and the sheet bundle is discharged from the processing tray 67 to a stacking tray 71*a*.

When the sheet conveyance destination is switched to the side of the book-binding path 62*e* by the changeover flapper 63*c*, the conveyance roller pair 61*g* is driven by a sheet discharge motor M3 (FIG. 7) and the conveyance roller pair 72 is driven by a conveyance motor M10 (FIG. 7), whereby the sheet is guided to the book-binding path 62*e* and then conveyed to a book-bind processing tray 79 serving as a stacking unit.

The book-bind processing tray 79 is provided with a sheet grasping member 79*a*, a movable sheet positioning member 79*b*, and a tip alignment member 79*c*, and also provided with an anvil 75*b* disposed facing a stapler 75*a*. The stapler 75*a* cooperates with the anvil 75*b* to perform staple processing (saddle stitching in this example) on a sheet bundle loaded on the book-bind processing tray 79.

On the downstream side of the stapler 75*a*, a folding roller pair 73 and a push-out member 76 are provided as a center folding unit. The push-out member 76 is disposed facing the folding roller pair 73. When the push-out member 76 is pushed out toward the sheet bundle loaded on the book-bind processing tray 79, the sheet bundle is pushed out between the folding roller pair 73 and center-folded, so that a folded part 300 is formed in the sheet bundle (see, FIGS. 6C and 6D). Subsequently, the folded part 300 of the sheet bundle is pressed by a press unit 77, thereby performing press processing to enhance the foldability of the sheet bundle.

After completion of the press processing, folding conveyance roller pairs 74*a*, 74*b* operate to discharge the sheet bundle to a book-binding tray 78. A conveyance sensor 80*b* is disposed between the folding conveyance roller pairs 74*a*, 74*b*, a conveyance sensor 80*c* is disposed downstream of the roller pairs 74*a*, 74*b*, and a conveyance sensor 80*d* is provided in the book-binding tray 78.

Figure 6A:
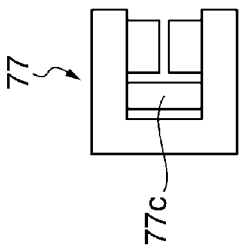
FIGS. 6A and 6B are views of a press unit as seen from a width direction of a sheet bundle and as seen from above the sheet bundle, respectively.
Figure 6B:
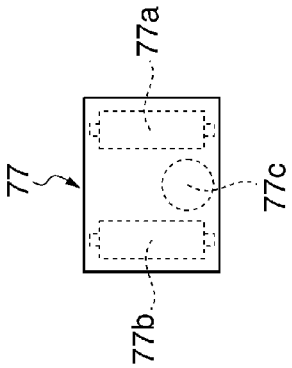

FIG. 6A shows the press unit 77 as seen from a width direction of a sheet bundle, and FIG. 6B shows the press unit 77 as seen from a direction perpendicular to the sheet bundle, i.e., from above the sheet bundle.

As shown in FIGS. 6A and 6B, the press unit 77 has press roller pairs 77*a*, 77*b* whose axes are parallel to each other, and has a flattening roller 77*c*. The flattening roller 77*c* has an axis extending perpendicular to the axes of the press roller pairs 77*a*, 77*b* and is disposed between the roller pairs 77*a*, 77*b* in the width direction of sheet bundle.

The flattening roller 77*c* presses a folded part 300 of a sheet bundle from a direction opposite from the conveyance direction of sheet bundle, thereby flattening the folded part 300. The press roller pairs 77*a*, 77*b* press the folded part 300 of the sheet bundle from a direction perpendicular to a front surface of the sheet bundle, thereby strengthening the folded part 300.

Figure 6C:
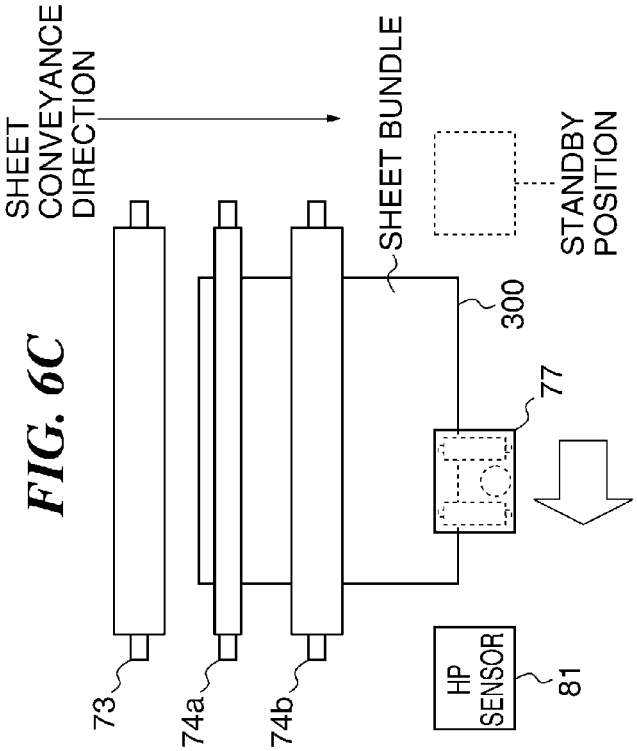
FIGS. 6C and 6D are views of a region from a folding roller pair to the press unit as seen from above the sheet bundle.
Figure 6D:
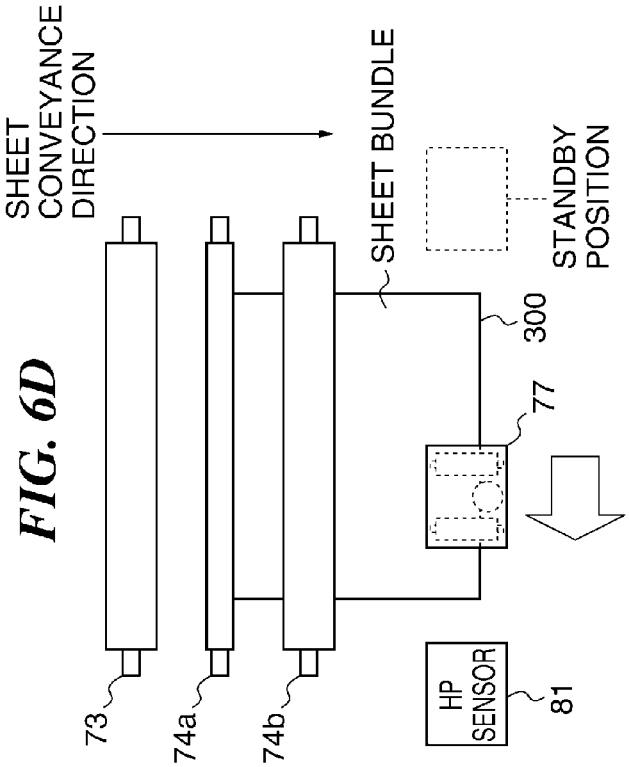

FIGS. 6C and 6D show a region from the folding roller pair 73 to the press unit 77 as seen from a direction perpendicular to a sheet bundle (i.e., as seen from above the sheet bundle). FIG. 6C shows how the folded part 300 is pressed, and FIG. 6D shows how the folded part 300 of the sheet bundle is pressurized by the flattening roller 77*c* to flatten a rear face of the sheet bundle, concurrently with the folded part 300 being pressed.

As shown in FIG. 6C, the press unit 77 is moved from a standby position in a direction directed to home position, i.e., in a width direction perpendicular to the conveyance direction of the sheet bundle, whereby the folded part 300 of the sheet bundle is nipped between the press roller pairs 77*a*, 77*b* to reduce the bulge of the sheet bundle. At that time, as shown in FIG. 6D, the position of the sheet bundle relative to the press unit 77 is made deeper, so that the flattening roller 77*c* is abutted against the rear face of the sheet bundle, whereby the rear face of the sheet bundle can be flattened.

Next, a description will be given of the schematic construction and control operation of the finisher controller 96 that drives and controls the finisher 6.

Figure 7:
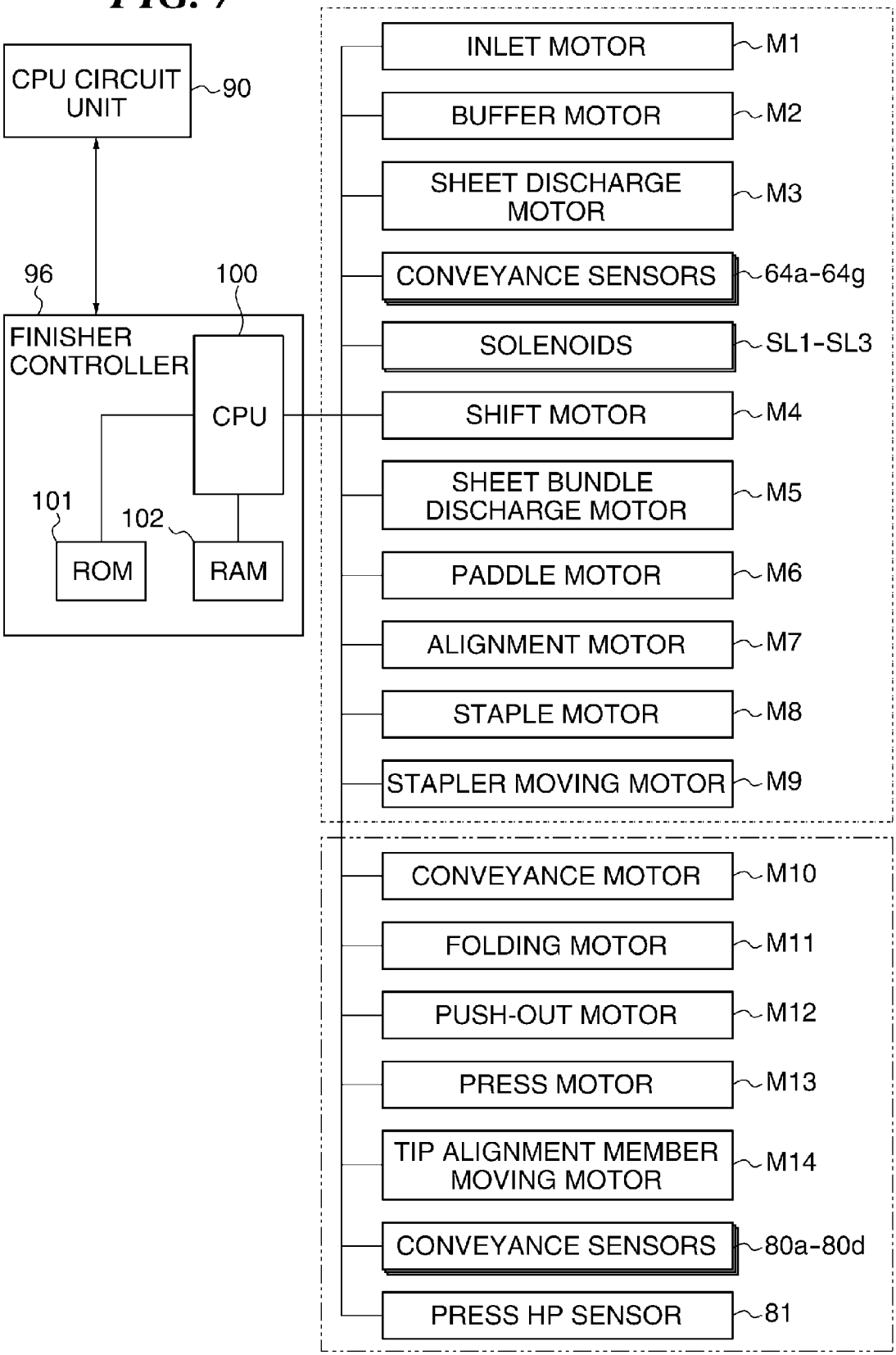
FIG. 7 is a block diagram showing the functional construction of the finisher.

As shown in FIG. 7, the finisher controller 96 has a CPU 100, a ROM 101, a RAM 102, etc., and communicates with the CPU circuit unit 90 of the image forming apparatus 1 for data exchange. According to an instruction from the CPU circuit unit 90, the finisher controller 96 executes various programs stored in the ROM 101 to drive and control the finisher 6.

The CPU 100 of the finisher controller 96 is connected with motors M1-M14, and drives and controls the motors M1-M14. It should be noted that each of the illustrated motors includes a motor driving circuit.

The inlet motor M1, buffer motor M2, and sheet discharge motor M3 drive the conveyance roller pairs 61*a*-61*c*, conveyance roller pair 61*d*, and conveyance roller pairs 61*e*-61*h* of the finisher 6, respectively. The shift motor M4 drives the shift unit 65 of the finisher 6.

To perform staple processing (binding processing) to bind a rear end, in the sheet conveyance direction, of a bundle of sheets stacked on the processing tray 67 by the stapler 66, the motors M5-M9 are driven and controlled by the CPU 100. The sheet bundle discharge motor M5, paddle motor M6, and alignment motor M7 drive the sheet bundle discharge roller pair 70, the paddle 69, and the alignment member 68 of the finisher 6 (FIG. 5), respectively. The staple motor M8 drives the stapler 66. The stapler moving motor M9 causes the stapler 66 to move along an outer periphery of the processing tray 67 in a direction perpendicular to the sheet conveyance direction.

To enable the book-bind processing tray 79, the press unit 77, etc. of the finisher 6 to achieve a bookbinding function, the CPU 100 drives and controls the motors M10-M14.

The conveyance motor M10 drives the conveyance roller pair 72 of the finisher 6, the folding motor M11 drives the folding roller pairs 73 and the folding conveyance roller pairs 74*a*, 74*b*, and the push-out motor M12 drives the push-out member 76. The press motor M13 drives the press unit 77. The tip alignment member moving motor M14 moves the tip alignment member 79*c* of the book-bind processing tray 79.

The CPU 100 is connected with conveyance sensors 64*a*-64*g*, conveyance sensors 80*a*-80*d*, and a press home position (HP) sensor 81. The conveyance sensors 64*a*-64*g* are disposed in the paths 62*a*-62*e*, etc. in the finisher 6, and output sheet passage detection signals, respectively. The conveyance sensors 80*a*-80*d* are disposed at locations shown in FIG. 5 and output sheet passage detection signals, respectively. The press HP sensor 81 outputs an ON signal when the press unit 77 is positioned at a home position. The CPU 100 detects a sheet conveyance position according to the sheet passage detection signals output from the conveyance sensors 64*a*-64*g* and 80*a*-80*d*, and determines whether or not the press unit 77 is at the home position according to a signal from the press HP sensor 81.

The CPU 100 is connected with solenoids SL1-SL3. The solenoids SL1-SL3 drive the changeover flappers 63*a*-63*c* of FIG. 5, respectively. It should be noted that each of the illustrated solenoids includes a driving circuit.

Next, a description will be given of a method for setting the book-binding mode via the operation display apparatus 5 of the image forming apparatus 1. FIGS. 8A-8D show an example of screen transition on the operation display apparatus 5 at the time of book-binding mode setting.

Figure 8A:
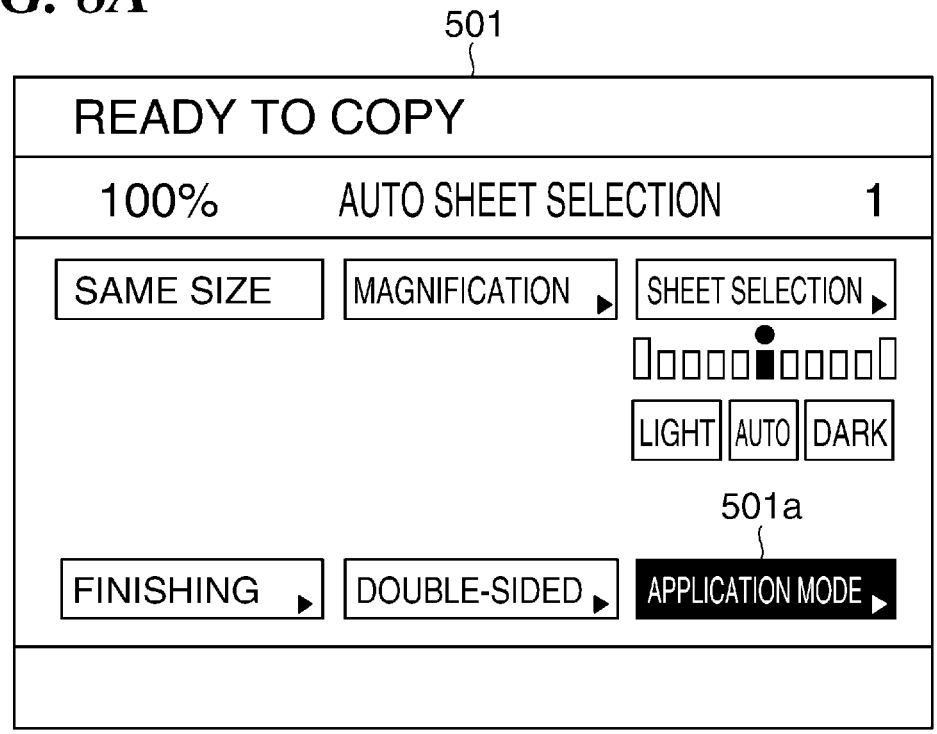
FIGS. 8A to 8D are views showing an example of screen transition on the operation display apparatus at the time of book-binding mode setting.
Figure 8B:
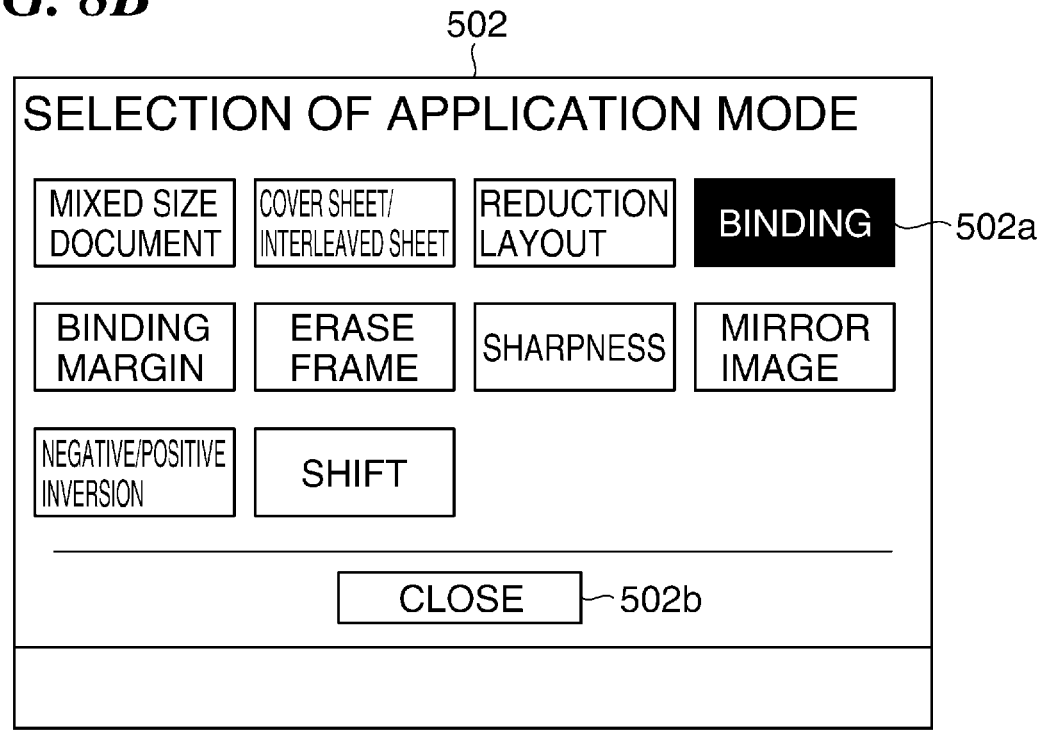

When the book-binding mode is set by the user through the display unit 50 of the operation display apparatus 5, an initial screen 501 shown in FIG. 8A is displayed on the display unit 50. When an application mode key 501*a* is selected and depressed by the user from among soft keys displayed on the initial screen 501, a shift is made from the initial screen 501 to an application mode selection screen 502 (FIG. 8B) under the control of the CPU 90*a*.

Figure 8C:
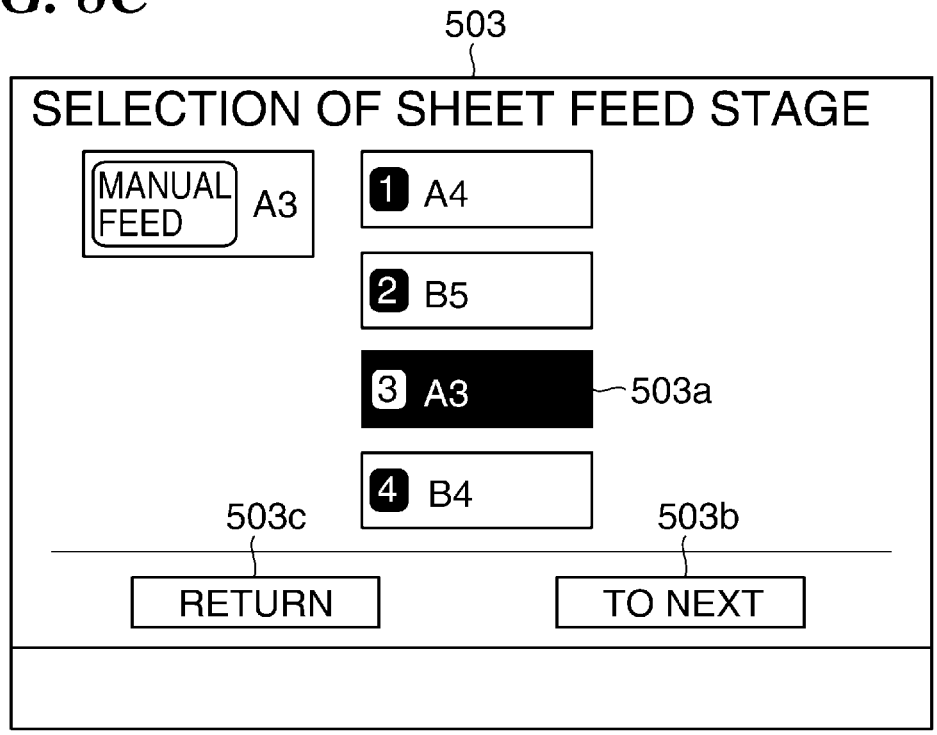

When a bookbinding key 502*a* is selected and depressed by the user on the application mode selection screen 502, a shift is made from the screen 502 to a sheet feed stage selection screen 503 (FIG. 8C). On the other hand, when a close key 502*b* is depressed by the user on the application mode selection screen 502, a shift is made from the selection screen 502 to the initial screen 501.

Figure 8D:
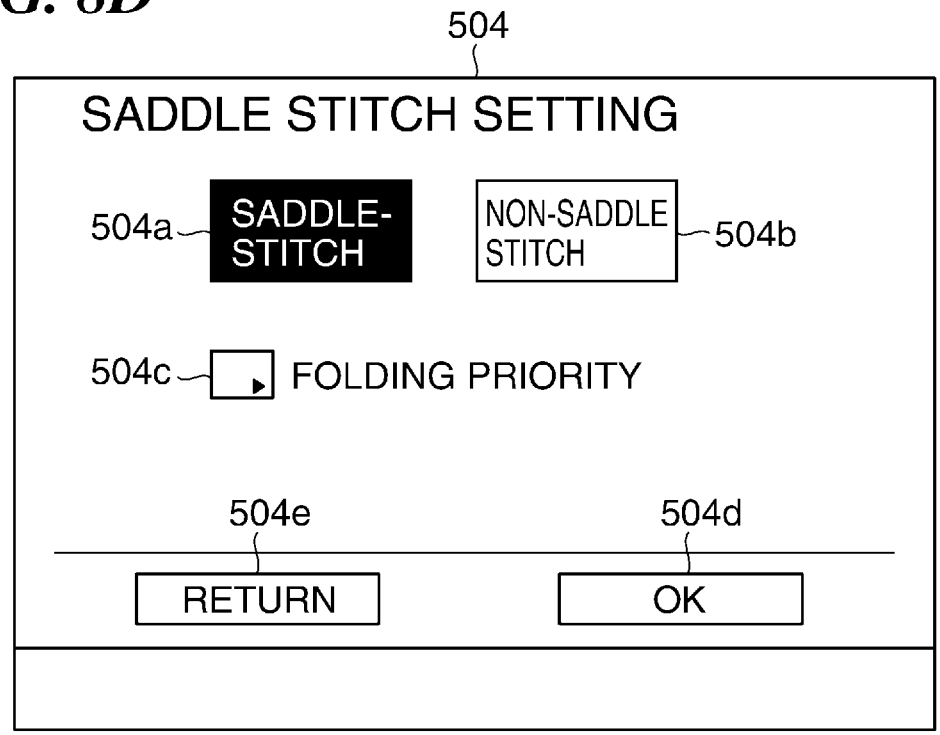

When a sheet feed stage selection key (e.g., an A3 key 503*a*) and a to next key 503*b* are depressed in this order by the user on the sheet feed stage setting screen 503, a shift is made from the screen 503 to a saddle stitch setting screen 504 (FIG. 8D). On the other hand, when a return key 503*c* is depressed by the user on the sheet feed stage setting screen 503, a shift is made from the setting screen 503 to the application mode selection screen 502.

The saddle stitch setting screen 504 is used to set whether saddle stitching and folding priority are necessary or not. When a saddle-stitch key 504*a*, a folding priority key 504*c*, and an OK key 504*d* are depressed in this order by the user on the saddle stitch setting screen 504, the CPU 90*a* of the controller 9 (FIG. 3) sets saddle stitching and folding priority (predetermined mode) to post-processing mode and folding mode in the sheet information J1 (FIG. 2A), respectively.

It is assumed here, for example, that a sheet feed stage in which sheets of A3 size and of 80 g/m$^2$ basis weight are set is selected on the sheet feed stage setting screen 503, and saddle stitching and folding priority are selected on the saddle stitch setting screen 504. In this case, 420 mm, 297 mm, 80 g/m$^2$, saddle stitching, and folding priority mode are respectively set in sheet length (long side length), sheet width (short side length), basis weight, post-processing mode, and folding mode in the sheet information J1 (FIG. 2). In the folding priority mode, press processing is always performed on a saddle stitched sheet bundle by the press unit 77, and flattening processing is selectively performed on the sheet bundle.

When the saddle-stitch key 504*a* and the OK key 504*d* are depressed in this order by the user on the saddle stitch setting screen 504, saddle stitching (stitch bookbinding) is set in the post-processing mode in the sheet information J1. When a non-saddle stitch key 504*b* and the OK key 504*d* are depressed in this order by the user on the saddle stitch setting screen 504, non-saddle stitching (non-stitch bookbinding) is set in the post-processing mode in the sheet information J1. In a mode other than the folding priority mode, press processing is selectively performed on the saddle stitched sheet bundle by the press unit 77. When a return key 504*e* is depressed by the user on the saddle stitch setting screen 504, a shift is made from the screen 504 to the sheet feed stage setting screen 503.

When the saddle-stitch key 504*a* or the non-saddle stitch key 504*b* and the OK key 504*d* are depressed by the user on the saddle stitch setting screen 504, the book-binding mode setting is completed. When the start key 51 (FIG. 4A) is depressed by the user after completion of the book-binding mode setting, a book-binding process is started.

Next, with reference to FIGS. 9-11, a description will be given of the book-binding process performed by the finisher 6 in the book-binding mode.

Figure 9A:
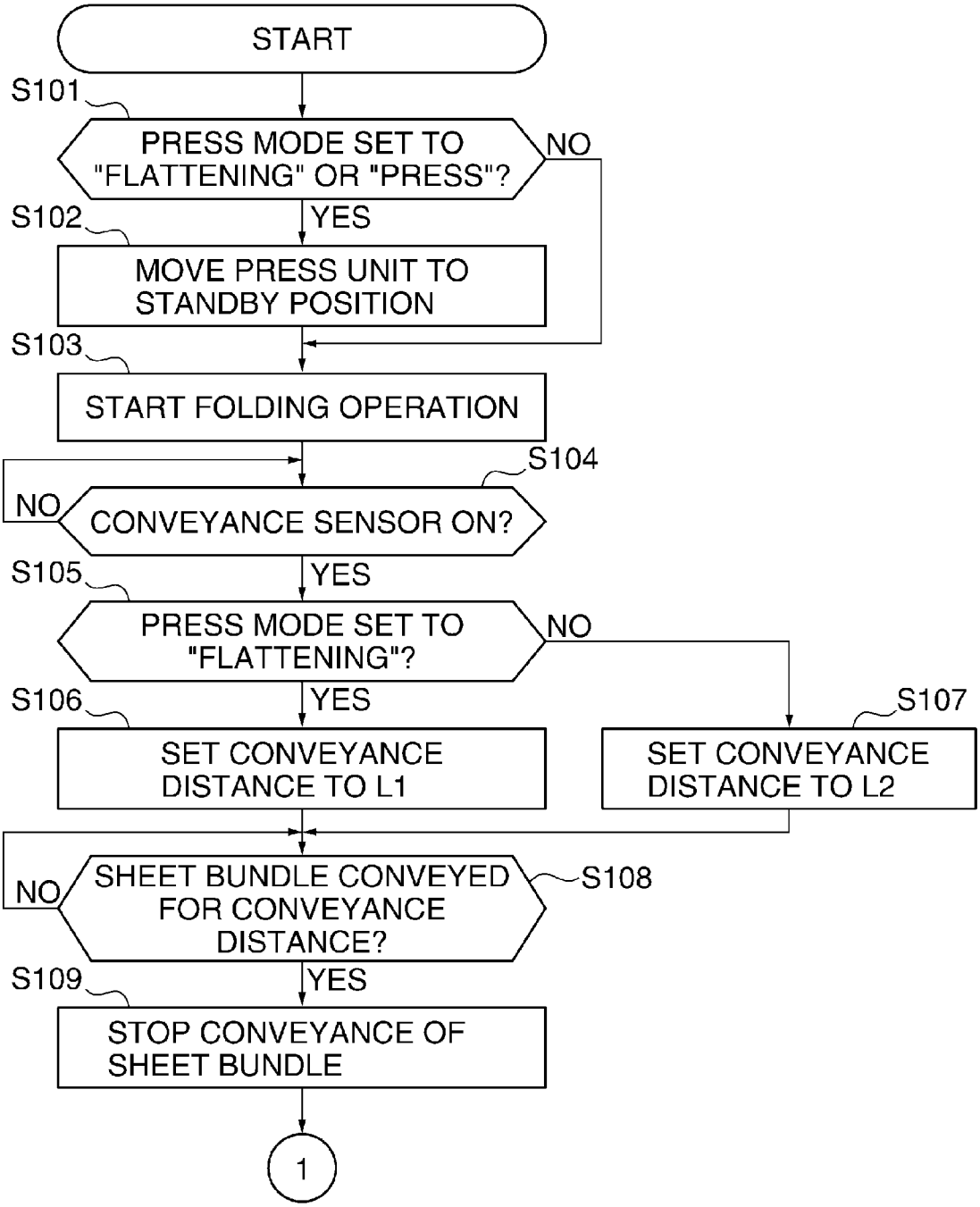
FIGS. 9A and 9B are a flowchart showing a book-binding process executed by the finisher.
Figure 9B:
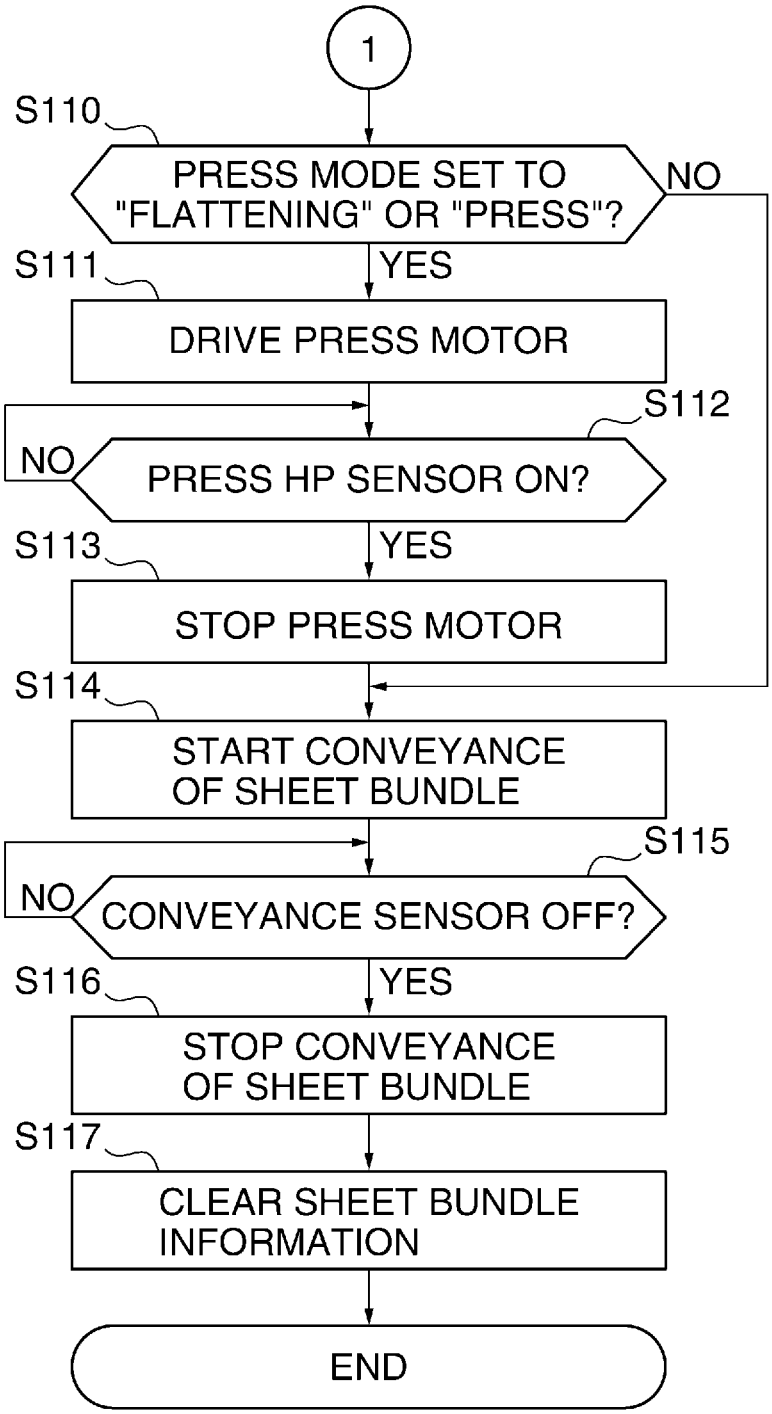

FIGS. 9A and 9B show in flowchart the book-binding process executed by the finisher 6. FIG. 10 shows a format of sheet bundle information J3 which is referred to by the CPU 100 of the finisher 6. The sheet bundle information J3 is created in a press mode setting process of FIG. 14 (described below) and stored in the RAM 102. FIGS. 11A-11E show a book-binding operation of the finisher 6.

As shown in FIG. 10, the sheet bundle information J3 includes information about bundle ID, the number of sheets of sheet bundle, sheet width, sheet length, basis weight, and press mode. The press mode information indicates to which of "flattening," "press," and "pressless" the press mode is set. When the press mode is set to "press," a press operation to press a sheet bundle is performed on a saddle stitched sheet bundle to reduce the bulge of the sheet bundle. When the press mode is set to "flattening," the press operation is performed on the saddle stitched sheet bundle and flattening processing is also performed on the sheet bundle to flatten the rear face of the sheet bundle by the flattening roller 77*c*. When the press mode is set to "pressless," the press operation is not performed on the saddle stitched sheet bundle.

When a job in which the number of processing copies, etc. are specified is input, the book-binding process of FIGS. 9A and 9B is started. In step S101, the CPU 100 of the finisher 6 determines whether or not the press mode is set to "flattening" or "press," while referring to the sheet bundle information J3 associated with a sheet bundle of K-th copy (hereinafter, referred to as the sheet bundle K) among the number of processing copies.

If the press mode is set to "flattening" or "press" (YES to step S101), the CPU 100 causes the press unit 77 to move to a standby position (step S102), and proceeds to step S103. On the other hand, if the press mode is set to "pressless" (NO to step S101), the process proceeds to step S103.

Figure 11A:
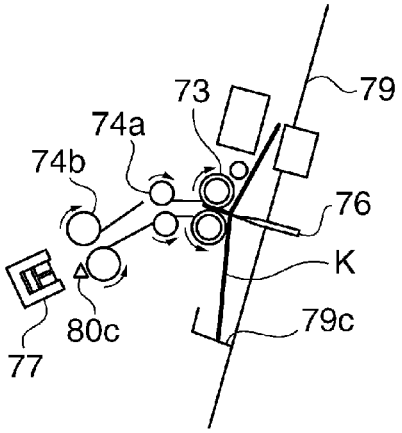
FIGS. 11A to 11E are views showing a book-binding operation of the finisher.

In step S103, the CPU 100 causes a folding operation to start. More specifically, the CPU 100 drives the motor M11 to rotate the folding roller pair 73 and the folding conveyance roller pairs 74*a*, 74*b*, and drives the push-out motor M12 to cause the push-out member 76 to push out toward a sheet bundle loaded on the book-bind processing tray 79. As a result, as shown in FIG. 11A, the sheet bundle K is pushed out by the push-out member 76 toward the folding roller pair 73, is center-folded by the folding roller pair 73, and is conveyed by the folding conveyance roller pairs 74*a*, 74*b* to the press unit 77.

Next, the CPU 100 determines whether or not the conveyance sensor 80*c* disposed downstream of the folding conveyance roller pairs 74*a*, 74*b* is ON (step S104). If the conveyance sensor 80*c* is ON (YES to step S104), the CPU 100 determines that the sheet bundle reaches the sensor 80*c*, and determines whether or not the press mode is set to "flattening, " while referring to sheet bundle information J3 for the sheet bundle K (step S105).

If the press mode is set to "flattening" (YES to step S105), the CPU 100 sets a conveyance distance from the conveyance sensor 80*c* to L1, e.g., 64 mm (step S106). On the other hand, if the press mode is set to "press" or "pressless" (NO to step S105), the CPU 100 sets the conveyance distance from the conveyance sensor 80*c* to L2, e.g., 54 mm (step S107). In other words, when the press mode is set to "flattening," since the folded part 300 of the sheet bundle K must be abutted against the flattening roller 77*c* of the press unit 77, the conveyance distance L1 is set that is longer than the conveyance distance L2 used when the press mode is set to "press" or "pressless."

In step S108, the CPU 100 determines whether or not the sheet bundle K has been conveyed for the conveyance distance L1 or L2 set in step S106 or S107 from when the conveyance sensor 80*c* has become ON. If the answer to step S108 is YES, the process proceeds to step S109.

Figure 11B:
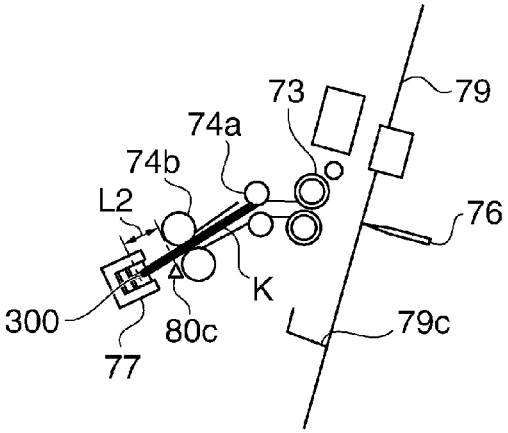
Figure 11C:
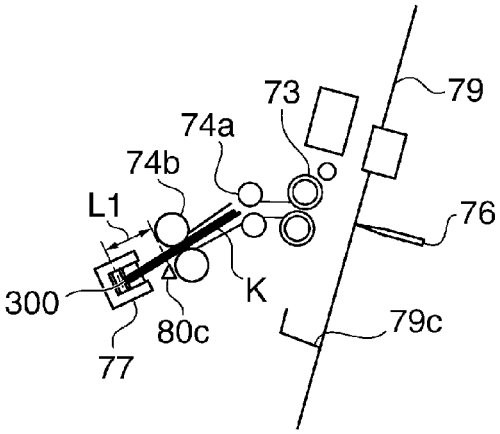

In step S109, the CPU 100 stops the folding motor M12 to thereby stop the sheet bundle K from being conveyed by the folding conveyance roller pairs 74*a*, 74*b*. FIG. 11B shows a state where the sheet bundle K is stopped after having been conveyed for the conveyance distance L2, and FIG. 11C shows a state where the sheet bundle K is stopped after having been conveyed for the conveyance distance L1.

Next, the CPU 100 determines whether or not the press mode is set to "flattening" or "press," while referring to the sheet bundle information J3 for the sheet bundle K (step S110). If the press mode is set to "flattening" or "press" (YES to step S110), the CPU 100 proceeds the process to step S111. On the other hand, if the press mode is set to "pressless" (NO to step S110), the process proceeds to step S114.

Figure 11D:
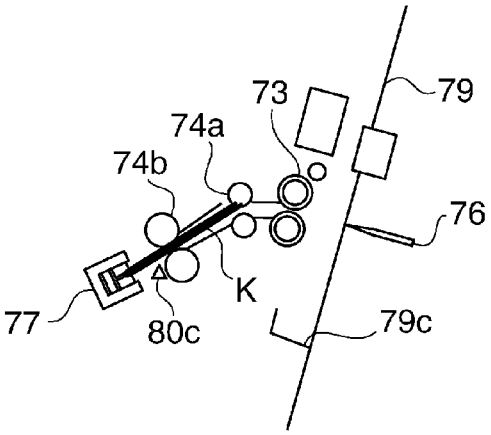

In step S111, the CPU 100 drives the press motor M13 to move the press unit 77, thereby performing press processing on the sheet bundle K (FIG. 11D). At that time, if the press mode is set to "flattening," flattening processing is performed to flatten the rear face of the sheet bundle by the flattening roller 77*c*.

In step S112, the CPU 100 determines whether or not the press home position (HP) sensor 81 is ON. If the press HP sensor 81 is ON (YES to step S112), the CPU 100 determines that the press processing on the sheet bundle K by the press unit 77 is completed, and stops the press motor M13 (step S113), whereby the press operation is stopped. In step S114, the CPU 100 drives the folding motor M12 to start conveyance of the sheet bundle K by the folding conveyance roller pairs 74*a*, 74*b*.

Figure 11E:
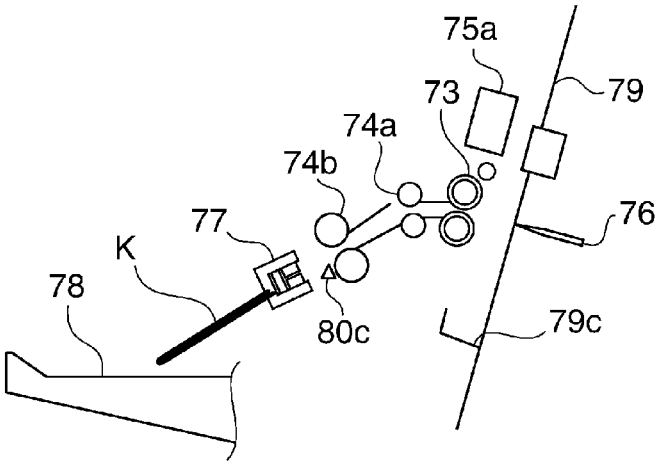

Next, in step S115, the CPU 100 determines whether or not the conveyance sensor 80*c* is OFF. If the conveyance sensor 80*c* is OFF, the CPU 100 stops the folding motor M12 to thereby stop the conveyance of the sheet bundle K (step S116). As a result, the discharge of the sheet bundle K by the folding conveyance roller pairs 74*a*, 74*b* is completed (FIG. 11E). Subsequently, the CPU 100 clears the sheet bundle information J3 for the sheet bundle K (step S117), and completes the book-binding operation.

Figure 12:
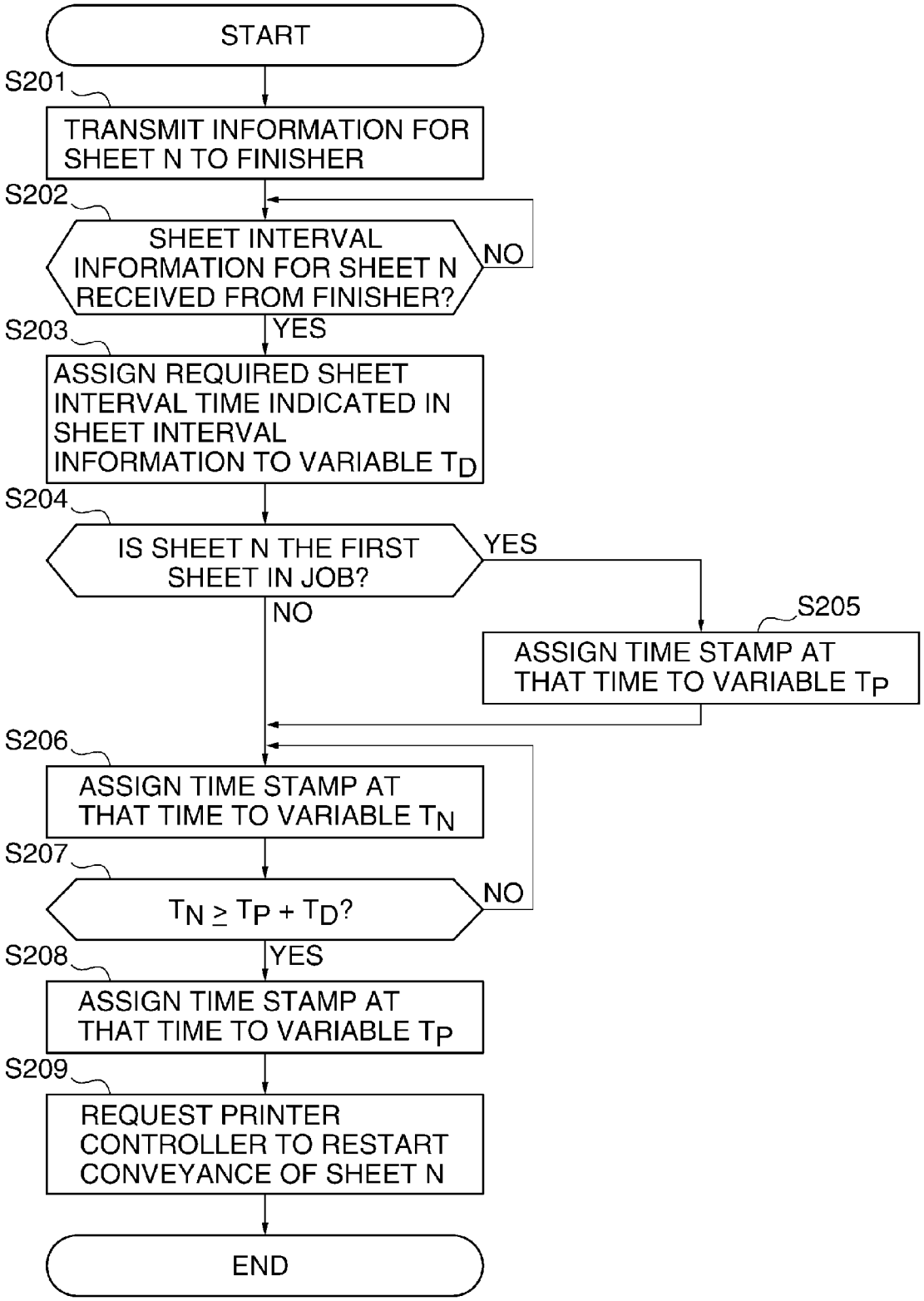
FIG. 12 is a flowchart showing a sheet interval control process executed by the image forming apparatus.

Next, a description will be given of sheet interval control. FIG. 12 shows in flowchart a sheet interval control process executed on each sheet by the image forming apparatus 1.

As previously described, when a sheet fed from e.g. the upper cassette 34 reaches the registration roller 44, sheet conveyance is temporarily stopped by the printer controller 94 according to an instruction from the CPU 90*a*. When the sheet stops at the registration roller 44, the sheet interval control process of FIG. 12 is started.

In step S201, the CPU 90*a* of the image forming apparatus 1 controls transmission of sheet information J1 (FIG. 2) for the sheet reached and stopped at the registration roller 44 (hereinafter, referred to as the sheet N) to the finisher 6 via the communication IC (not shown).

Standard sheet interval time information contained in the sheet information J1 represents a time calculated by the CPU 90*a* of the CPU circuit unit 90 of the image forming apparatus 1 by taking account the productivity in the image forming apparatus 1, and specifies an image forming time per sheet. For example, the standard sheet interval time is 500 msec in a case that images are printed on sheets at a printing speed of 120 sheets per one minute.

In step S202, the CPU 90*a* of the image forming apparatus 1 determines whether or not it receives the sheet interval information J2 for the sheet N (FIG. 2B) from the finisher 6.

When receiving the sheet interval information J2 (YES to step S202), the CPU 90*a* assigns required sheet interval time indicated in the received sheet interval information J2 to a variable TD written on the RAM 90*c* (step S203), and then determines whether or not the sheet N is a first sheet in the job (step S204).

If the sheet N is the first sheet (YES to step S204), the CPU 90*a* assigns a time stamp at that time to each of variables TP, TN on the RAM 90*c* and stores values of these variables (steps S205 and S206), and determines whether or not the variable TN has a value equal to or larger than the sum of values of the variables TP, TD (step S207). If the answer to step S207 is NO, the process returns to step S206. In other words, in a case that the sheet N is the first sheet in the job and there is no immediately preceding sheet N−1 that precedes the sheet N, it is unnecessary to take into account a sheet interval from the preceding sheet. Thus, it is enough to wait elapse of a time (equal to variable TD) required for the finisher 6 to perform receiving preparation.

On the other hand, if the sheet N is not the first sheet in the job and there is a preceding sheet (NO to step S204), the CPU 90*a* assigns a time stamp at that time to the variable TN on the RAM 90*c* and stores the value of this variable (step S206), and determines whether or not the variable TN has a value equal to or larger than the sum of the variables TP, TD (step S207). If the answer to step S207 is NO, the process proceeds to step S206. In other words, if the sheet N is not the first sheet in the job, waiting is made until the required sheet interval time TD has elapsed from the start time TP of conveyance of the preceding sheet N−1 by the registration roller 44, whereby the conveyance interval time TD between the preceding sheet N−1 and the sheet N is ensured.

If the relation of TN≥TP+TD is fulfilled (YES to step S207), the CPU 90*a* assigns a time stamp at that time to the variable TP and stores the value of this variable (step S208), and requests the printer controller 94 to restart the conveyance of the sheet N (step S209). In response to this, under the control of the printer controller 94, the conveyance of the sheet N is started by the registration roller 44.

Next, with reference to FIGS. 13-15, a description will be given of the flow in which the CPU 100 of the finisher 6 sets the press mode according to sheet information J1 for the sheet N received from the image forming apparatus 1 and notifies the image forming apparatus 1 of sheet interval information J2.

Figure 13A:
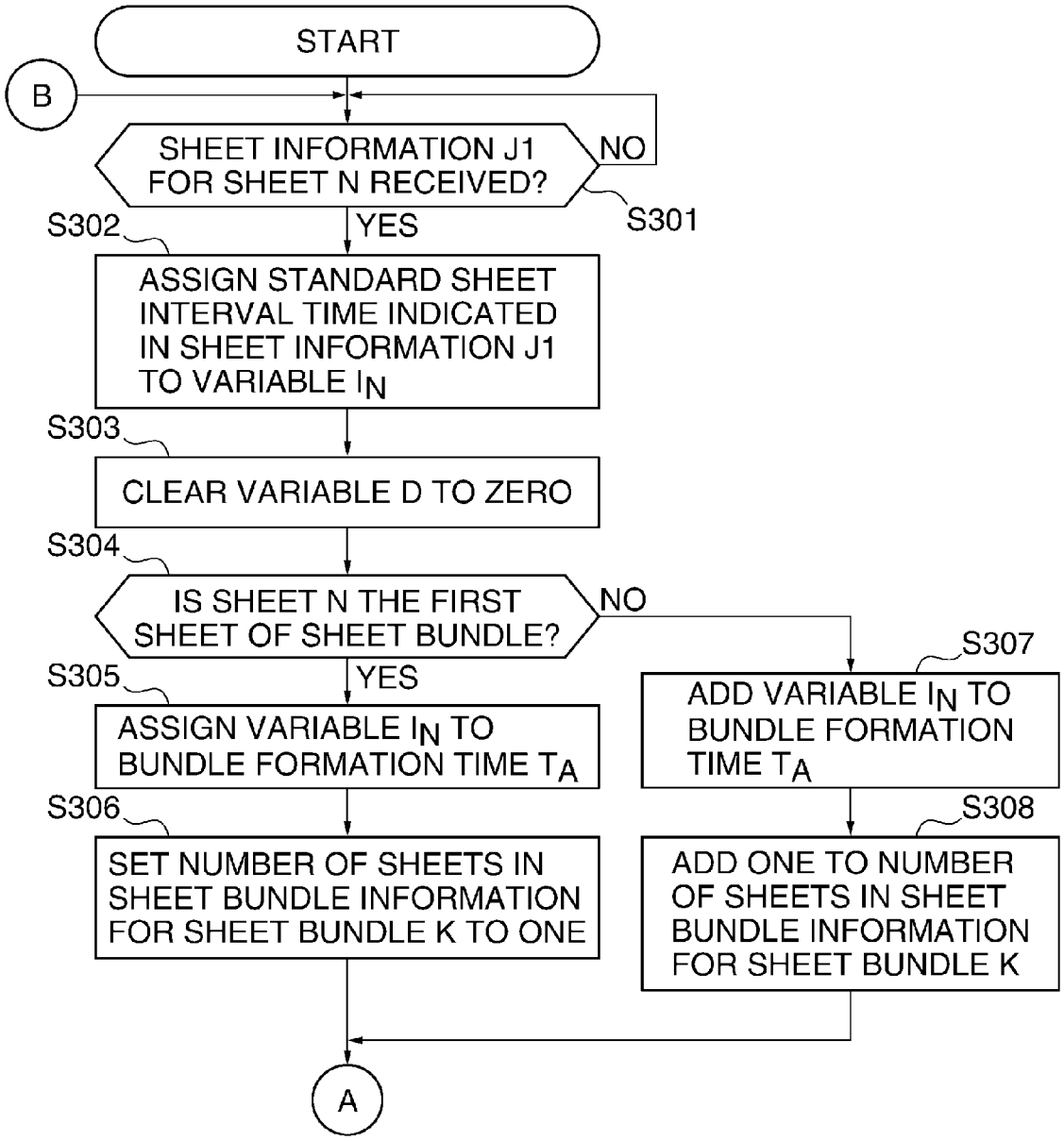
FIGS. 13A and 13B are a flowchart showing a sheet interval information notification process executed by the finisher.
Figure 13B:
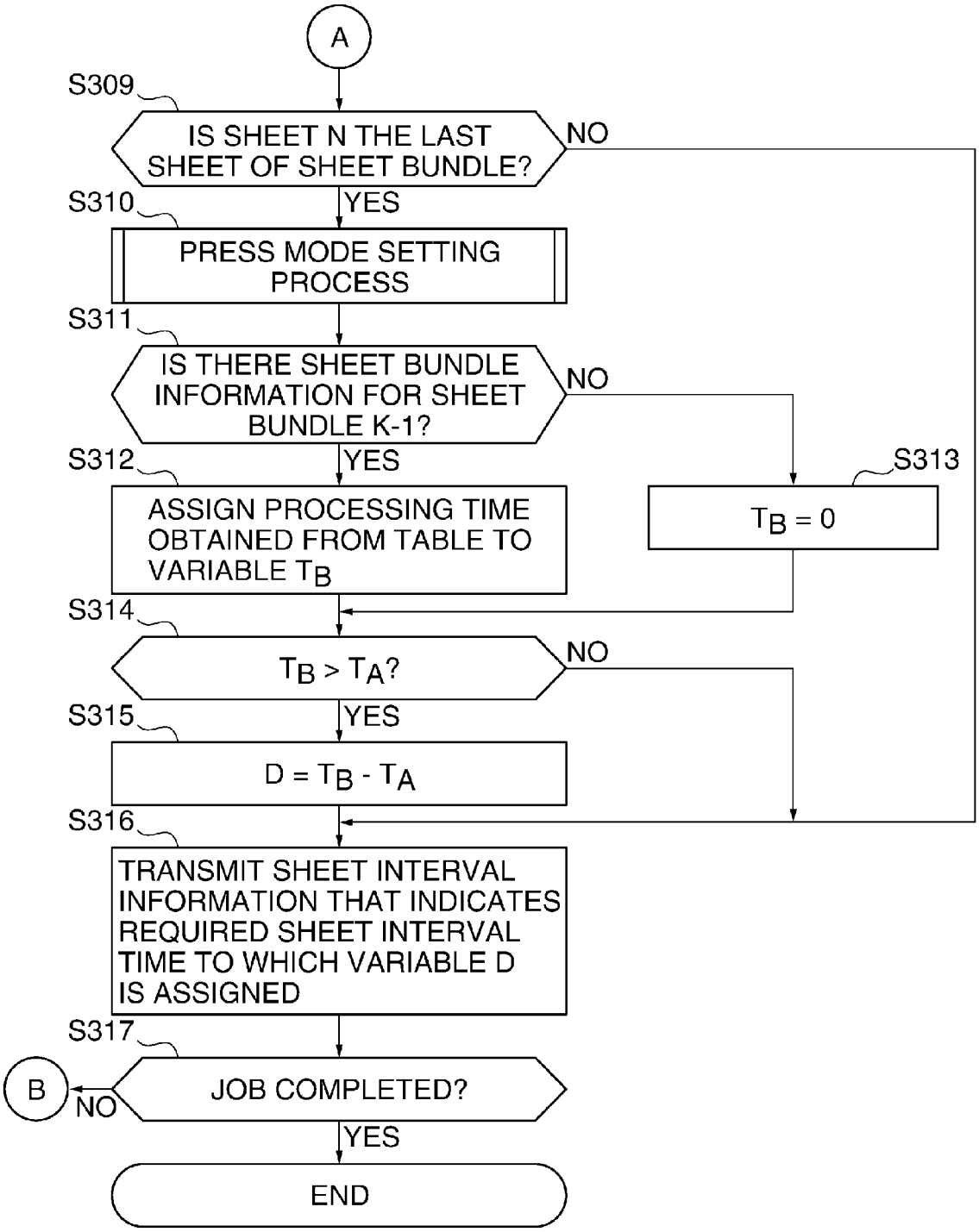

FIGS. 13A and 13B show in flowchart a sheet interval information notification process executed by the finisher 6. This process is started when a job is input.

First, the CPU 100 determines whether or not it receives sheet information J1 for the sheet N from the image forming apparatus 1 (step S301). If the sheet information J1 is received (YES to step S301), the CPU 100 stores the received sheet information J1 into the RAM. 102, assigns a standard sheet interval time indicated in the sheet information J1 to a variable IN written on the RAM 102, and stores the value of this variable (step S302).

Next, the CPU 100 clears a variable D, which is written on the RAM 102 and used to determine the required sheet interval time, to a value of 0 (step S303), and determines whether or not the sheet N is the first sheet of a sheet bundle K corresponding to the sheet N (step S304).

If the sheet N is the first sheet (YES to step S304), the CPU 100 assigns the value of the variable IN to a bundle formation time TA, which is a variable written on the RAM 102 (step S305). The bundle formation time TA represents a stack processing time that is expected to be required for sheets to be stacked on the book-bind processing tray 79 and formed into the sheet bundle K. Next, the CPU 100 sets the number of sheets of the sheet bundle in the sheet bundle information J3 for the sheet bundle K to a value of 1 (step S306), and proceeds the process to step S309.

On the other hand, if the sheet N is not the first sheet (NO to step S304), the CPU 100 adds the value of variable IN to the bundle formation time TA to update the bundle formation time TA (step S307), and adds a value of 1 to the number of sheets of the sheet bundle in the sheet bundle information J3 for the sheet bundle K, thereby updating the number of sheets that constitute the sheet bundle K (step S308). Next, the CPU 100 determines whether or not the sheet N is the last sheet of the sheet bundle K to which the sheet N will belong (step S309).

If the sheet N is not the last sheet (NO to step S309), the CPU 100 assigns the value of the variable D cleared to 0 in step S303 to the required sheet interval time in the sheet interval information J2, and transmits the sheet interval information J2 to the image forming apparatus 1 via the communication IC, not shown (step S316).

If the sheet N is the last sheet (YES to step S309), the CPU 100 executes a press mode setting process (FIG. 14), which will be described detail later, for the sheet bundle K (step S310), and determines whether or not there is sheet bundle information J3 for the preceding sheet bundle K−1 on the RAM 102 (step S311).

If there is sheet bundle information J3 for the sheet bundle K−1 (YES to step S311), the CPU 100 determines that the book-binding process for the sheet bundle K−1 has not been completed, obtains book-bind processing time from a book-bind processing time table TBL1 (FIG. 15) according to the sheet bundle information J3 for the sheet bundle K−1, and assigns and stores the obtained time to a variable TB on the RAM 102 (step S312). The variable TB represents a book-bind processing time (press processing time) expected to be required for the press processing of the sheet bundle K−1, which will be book bound. The table TBL1 is prepared in advance and stored in the ROM 101 or the like.

FIG. 15 shows the book-bind processing time table TBL1.

The table TBL1 is stored with information that indicates an expected value of a book-bind processing time (hereinafter, referred to the expected book-binding time) that varies depending on sheet size, the number of sheets of the sheet bundle, and press mode. In the case, for example, of a sheet bundle where sheet size is A4R (297 mm sheet length and 210 mm sheet width) and the number of sheets is 5, the expected book-binding time is 4500 msec, if the press mode is set to "press." In step S312, a value of 4500 is assigned to the variable TB.

If there is no sheet bundle information J3 for the sheet bundle K−1 (NO to step S311), the CPU 100 determines that the current sheet bundle K is the first sheet bundle in the job or determines that the sheet bundle K−1 has been discharged and the sheet bundle information J3 therefor has been cleared in step S117 of FIG. 9. Then, the CPU 100 assigns a value of 0 to the variable TB on the RAM 102 and stores the value of this variable (step S313).

In step S314, the CPU 100 compares the bundle formation time TA with the value of the variable TB to determine whether or not a relation of TB>TA is fulfilled. If there is the relation of TB>TA (YES to step S314), the time required to perform bookbinding of the sheet bundle K−1 is longer than the time required to stack the sheet bundle K. It is therefore necessary to provide a sheet interval for the sheet N, which is the last sheet of the sheet bundle K. Accordingly, the CPU 100 subtracts the bundle formation time TA from the value of the variable TB and sets the resultant value to the variable D written on the RAM 102 (step S315), and proceeds the process to step S316.

On the other hand, if the relation of TB>TA is not fulfilled (NO to step S314), the expected book-binding time for the sheet bundle K−1 is shorter than the stack processing time for the sheet bundle K even when there is the unbound sheet bundle K−1. It is therefore unnecessary to provide a sheet interval for the sheet N which is the last sheet of the sheet bundle K. Accordingly, the CPU 100 proceeds the process to step S316, with the value of the variable D cleared to 0 in step S303.

In step S316, the CPU 100 assigns the value of the variable D to the required sheet interval time in the sheet interval information J2, and transmits the sheet interval information J2 to the image forming apparatus 1 via the communication IC (not shown). Next, the CPU 100 determines whether or not the job has been completed (step S317). If the job has not been completed (NO to step S317), the process returns to step S301 in order to perform processing on the next sheet. On the other hand, if the job has been completed (YES to step S317), the CPU 100 completes the process of FIGS. 13A and 13B.

Figure 14:
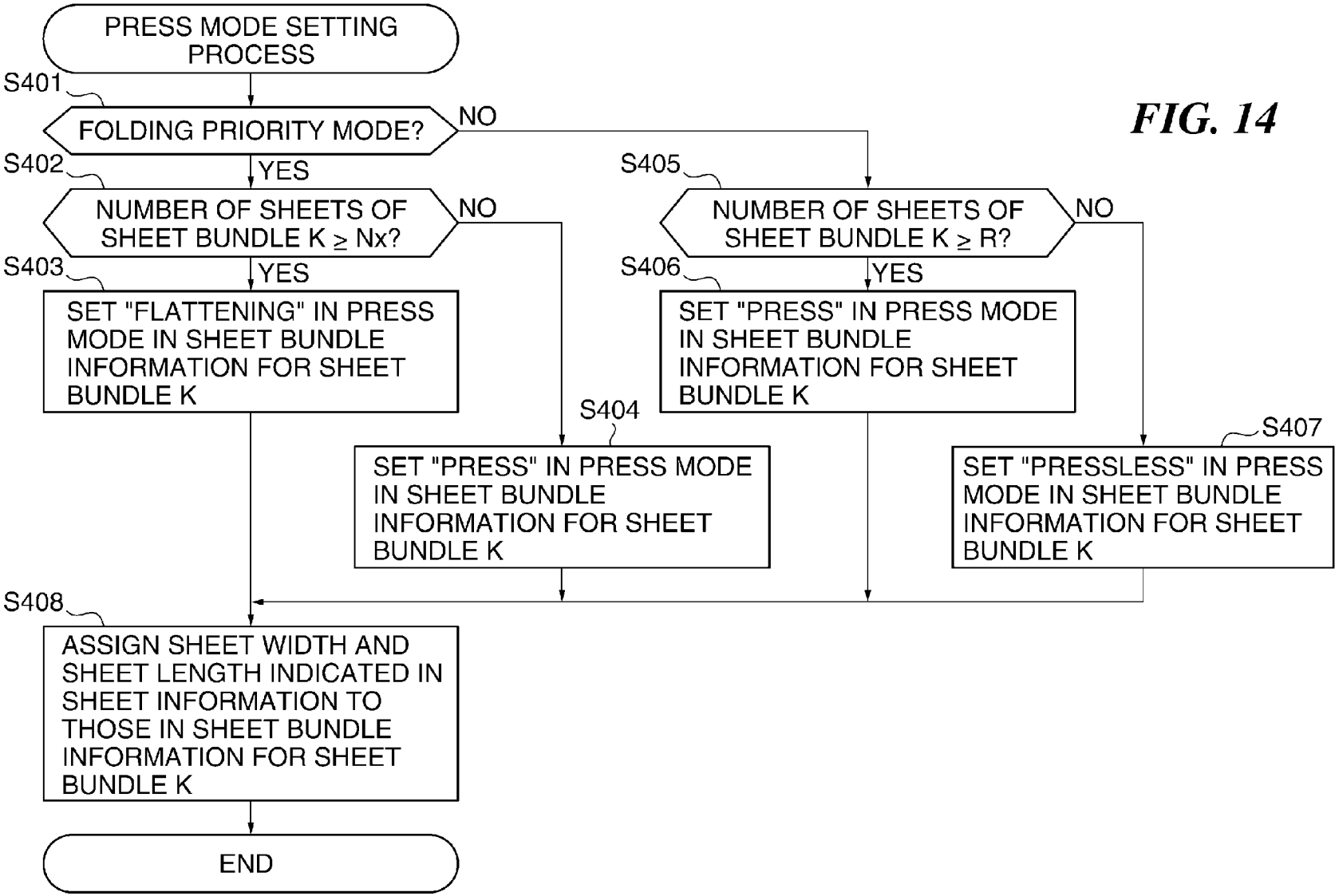
FIG. 14 is a flowchart showing a press mode setting process executed in step S310 of FIG. 13B.

FIG. 14 shows in flowchart the press mode setting process executed in step S310 of FIG. 13B.

In step S401, the CPU 100 determines whether or not the folding priority mode has been set in the folding mode indicated in the sheet information J1, while referring to the sheet information J1 (FIG. 2A) for the sheet N. If the folding priority mode has been set (YES to step S401), the CPU 100 determines whether or not the number of sheets of the sheet bundle has been set to be equal to or larger than a predetermined number of sheets, Nx (e.g., 10), while referring to the number of sheets of the sheet bundle indicated in the sheet bundle information J3 for the sheet bundle K, which is shown in FIG. 10 (step S402).

If the number of sheets of the sheet bundle has been set to be equal to or larger than e.g. 10 (YES to step S402), it is desirable to perform the flattening processing on the rear face of the sheet bundle. Accordingly, the CPU 100 sets "flattening" in the press mode in the sheet bundle information J3 for the sheet bundle K (step S403). On the other hand, if the number of sheets of the sheet bundle has been set to be less than e.g. 10 (NO to step S402), even when flattening processing is performed on the sheet bundle, the sheet bundle cannot be flattened satisfactorily, resulting in a fear that the appearance of the sheet bundle is degraded. Accordingly, the CPU 100 sets "press" in the press mode in the sheet bundle information J3 for the sheet bundle K (step S404).

If the folding priority mode has not been set in the sheet information J1 (NO to step S401), the CPU 100 determines whether or not the number of sheets of the sheet bundle indicated in the sheet bundle information J3 is equal to or larger than a threshold value R, while referring to the sheet bundle information J3 for the sheet bundle K (step S405).

In this embodiment, stack processing time for the sheet bundle K+1 becomes longer than press processing time for the sheet bundle K when the number of sheets is equal to or larger than 3, whereas the stack processing time for the sheet bundle K+1 becomes shorter than press processing time for the sheet bundle K when the number of sheets is equal to or less than 2. In that case, the threshold value R is set to 3.

If the number of sheets of the sheet bundle indicated in the sheet bundle information J3 is equal to or larger than the threshold value R, e.g., 3 (YES to step S405), the CPU 100 sets "press" in the press mode in the sheet bundle information J3 for the sheet bundle K (step S406). On the other hand, if the number of sheets of the sheet bundle is less than the threshold value R, e.g., 3 (NO to step S405), the bundle formation time TA is short. Thus, the CPU 100 sets the press mode in the sheet bundle information J3 for the sheet bundle K to "pressless" where the book-bind processing time is short (step S407). As a result, a value of the variable TB corresponding to the book-bind processing time for the sheet bundle K becomes small, and therefore the required sheet interval time TD corresponding to the value of the variable D becomes short. In that case, a waiting time for the next sheet bundle K+1 can be prevented from being generated, whereby the productivity can be improved.

After completion of the press mode setting in step S403, S404, S406, or S407, the CPU 100 proceeds the process to step S408 where the sheet width and sheet length indicated in the sheet information J1 for the sheet N are assigned to those in the sheet bundle information J3 for the sheet bundle K, whereupon the press mode setting process of FIG. 14 is completed.

Next, a description will be given of a specific example of the sheet interval information notification process of FIGS. 13A and 13B.

It is assumed here for example that a job is input, which specifies that the number of processing copies (the number of sheet bundles) is equal to 2 and which specifies printing of images on two A3 sheets of each sheet bundle at a printing speed of 20 sheets per minute.

In that case, processing in steps S301-S306, S309, and S316 of FIGS. 13A and 13B is performed on the first sheet of the first copy (K=1), i.e., on the bundle first sheet. More specifically, in step S305, the standard sheet interval time of 3000 msec indicated in the sheet information J1 is set as the bundle formation time TA. In step S316, the sheet interval information J2 indicating that the required sheet interval time is equal to 0 is transmitted to the image forming apparatus 1.

The processing in steps S301-S304, S307-S311, S313, S314, and S316 of FIGS. 13A and 13B is performed on the second sheet of the first copy, i.e., on the bundle last sheet.

More specifically, in step S307, the current bundle formation time TA of 6000 msec is calculated by adding the standard sheet interval time of 3000 msec in the sheet information J1 to the preceding bundle formation time TA of 3000 msec. In the press mode setting process (FIG. 14) in step S310, if the folding priority has been set in the folding mode in the sheet information J1, the processing in steps S401, S402, S404, and S408 is performed, and the press mode is set to "press". On the other hand, if the folding priority has not been set, the processing in steps S401, S405, S407, and S408 is performed, and the press mode is set to "pressless". In step S316, sheet interval information J2 in which the required sheet interval time equal to 0 is indicated is transmitted to the image forming apparatus 1.

The processing in steps S301-S306, S309, and S316 of FIGS. 13A and 13B is performed on the first sheet of the second copy (bundle first sheet). More specifically, in step S305, the standard sheet interval time of 3000 msec indicated in the sheet information J1 is set as the bundle formation time TA. In step S316, the sheet interval information J2 in which the required sheet interval time equal to 0 is indicated is transmitted to the image forming apparatus 1.

The processing in steps S301-S304, S307-S312, S314, (S315), and S316 of FIGS. 13A and 13B is performed on the second sheet of the second copy (bundle last sheet).

More specifically, in step S307, the current bundle formation time TA of 6000 msec is calculated by adding the standard sheet interval time of 3000 msec indicated in the sheet information J1 to the preceding bundle formation time TA of 3000 msec. It is assumed here that it is determined in the press mode setting process of FIG. 14 executed in step S310 that the folding priority mode has been set in the folding mode in the sheet information J1. In a case that the press mode is set to "press", since the sheet size is A3 and the number of sheets is 2 in this example, a value of 6500 is obtained from the table TBL1 (FIG. 15) and assigned to the variable TB in step S312. In step S314, it is determined that the value of variable TB (=6500) is larger than the value of TA (=6000). In step S316, D (=500) obtained in step S315 by subtracting 6000 from 6500 is set as the required sheet interval time in the sheet interval information J2. In that case, the second sheet of the second copy waits in the image forming apparatus 1 for 500 msec.

On the other hand, if determined in the press mode setting process of FIG. 14 that the folding priority mode has not been set in the sheet information J1 and the press mode is set to "pressless," a value of 5700 is obtained from the table TBL1. Since the value of TB (=5700) is smaller than the value of TA (=6000), the required sheet interval time in the sheet interval information J2 is set to 0 in step S316. It is therefore unnecessary for the second sheet of the second copy to wait in the image forming apparatus 1, and the productivity is not lowered. In a case that the folding priority is not selected, the required sheet interval time in the sheet interval information J2 is set to 0, if the number of sheets is less than the threshold value R, as described above, and no waiting time is generated in the image forming apparatus 1.

It is preferable that the threshold value R used in step S405 of FIG. 14 to determine the number of sheets of the sheet bundle be set to the largest value in a range where the productivity is not lowered. In the example described above, the threshold value R is set to a fixed value e.g. 3 irrespective of sheet size, but this is not limitative. For example, the threshold value R can be set according to sheet size. If the printing speed can be varied, the threshold value R can be set according to the printing speed. In the following, a description will be given of a case where the threshold value R is variably set.

Figure 16:
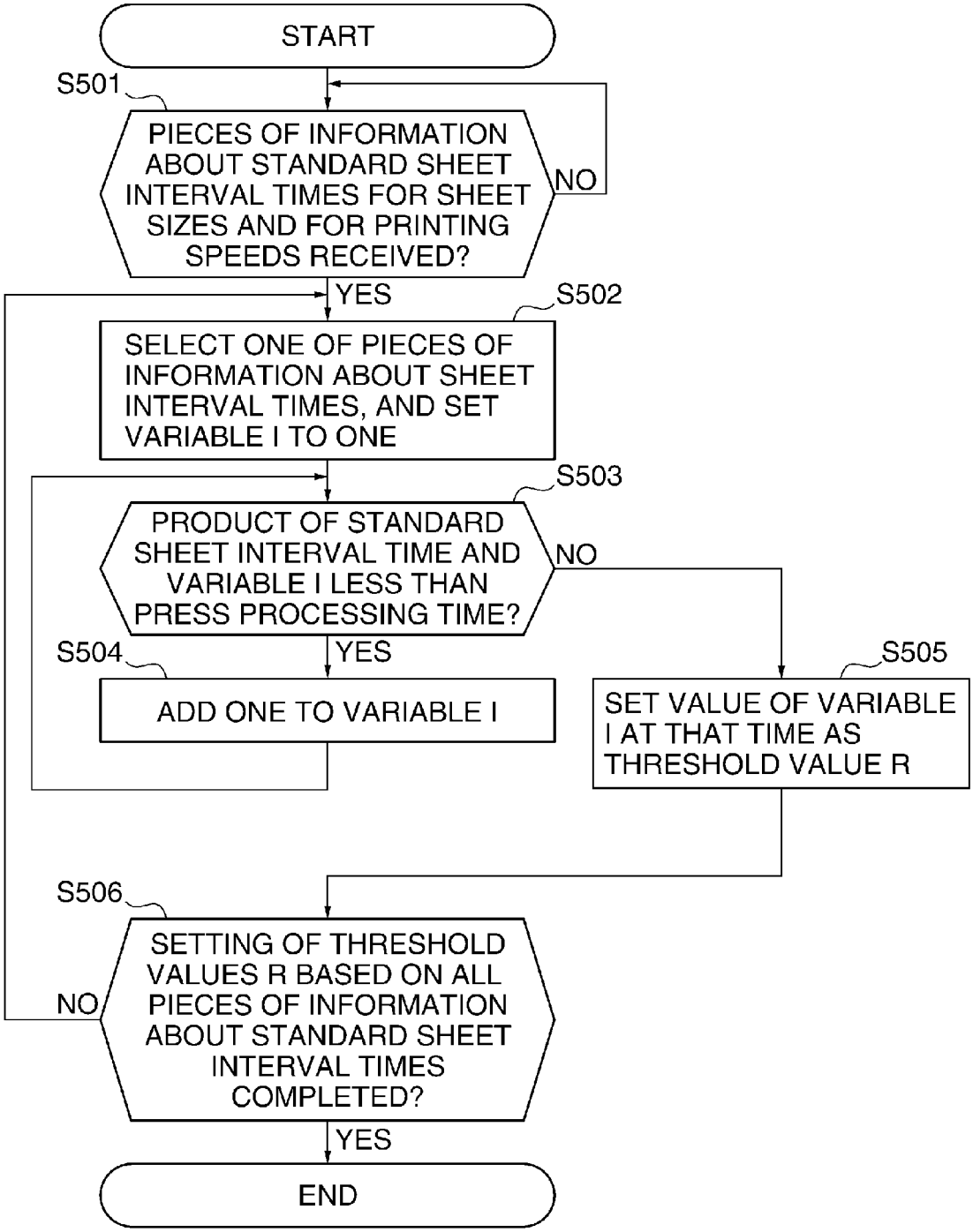
FIG. 16 is a flowchart showing a threshold value setting process in which a threshold value used in step S405 of FIG. 14 is set according to sheet size and printing speed.

FIG. 16 shows in flowchart a threshold value setting process, and FIG. 17 shows an example of a threshold value table created in the setting process of FIG. 16.

The threshold value setting process of FIG. 16 is performed by the CPU 100 of the finisher 6, and is started at start-up of the image forming system.

At start of the threshold value setting process, the CPU 100 determines whether or not it receives pieces of information about standard sheet interval times for respective sheet sizes and for respective printing speeds (step S501). If the answer to step S501 is NO, the process returns to step S501. When receiving pieces of information about standard sheet interval times (YES to step S501), the CPU 100 selects one of the pieces of information, and sets a variable I written on the RAM 102 to a value of 1 (step S502).

In step S503, the CPU 100 multiplies the standard sheet interval time represented by the information selected in step S501 by a value of the variable I, thereby determining a stack processing time expected to be required to stack a sheet bundle. It should be noted that the sheet bundle to be stacked has a sheet size corresponding to the selected information and has the number of sheets equal to I. From the table TBL1 (FIG. 15), the CPU 100 obtains a press processing time (book-bind processing time) expected to be required to perform press processing on the sheet bundle. Then, the CPU 100 determines whether or not the calculated stack processing time (i.e., the product of standard sheet interval time and variable I) is shorter than the obtained press processing time.

If the stack processing time is shorter than the press processing time, the productivity is lowered when press processing is performed on the sheet bundle whose number of sheets is equal to I. Accordingly, if the answer to step S503 is YES, the CPU 100 adds a value of 1 to the variable I, thereby increasing the threshold value R compared with the number of sheets of the sheet bundle in step S405 of FIG. 14 in order to avoid the productivity from being lowered (step S504), and returns the process to step S503.

On the other hand, if the stack processing time is equal to or larger than the press processing time, the productivity is not lowered even when press processing is performed on the sheet bundle whose number of sheets is equal to I. Accordingly, if the answer to step S503 is NO, the CPU 100 sets the value of the variable I at that time as the threshold value R (step S505), whereby the threshold value R is set to the minimum value among values of the variable I where a relation of stack processing time (i.e., the product of standard sheet interval time and variable I)<press processing time is not fulfilled.

Next, the CPU 100 determines whether or not the setting of threshold values R based on all the pieces of information received in step S501 about standard sheet interval times for respective sheet sizes and for respective printing speeds is completed (step S506). If the answer to step S506 is NO, the CPU 100 returns to step S502 where standard sheet interval time information different from the precedingly selected information is newly selected, and based on the newly selected standard sheet interval time information, the processing in steps S504-S506 already described is performed. If the setting of threshold values R based on all the pieces of information about standard sheet interval times is completed (YES to step S506), the present process is completed.

In the threshold value setting process of FIG. 16, a threshold value table TBL2 as such shown in FIG. 17 can be created by setting threshold values R based on standard sheet interval time information for respective sheet sizes and for one certain printing speed. By creating similar threshold value tables TBL2 for other printing speeds, a group of threshold value tables TBL2 can be obtained. At execution of a job, the CPU 100 can obtain a threshold value R according to printing speed and sheet size from the group of threshold value tables TBL2 stored in advance in e.g. the RAM 102, and can use the obtained threshold value R in the press mode setting process of FIG. 14.

For example, in the case of forming images on sheets of A3 size at a printing speed of 30 sheets per minute, a threshold value R of 4 is selected from the group of threshold value tables TBL2. In that case, if the number of sheets, I, of the sheet bundle is equal to or larger than 4, the stack processing time, which is equal to the product of standard sheet interval time of 2000 msec and variable I (=4), becomes equal to or larger than the press processing time of 6000 msec. Thus, the productivity is not lowered, even if the press processing is performed.

It should be noted that the threshold value tables TBL2 created in the threshold value setting process of FIG. 16 can be stored in a non-volatile memory. By reading the threshold value tables TBL2 from the memory at each subsequent start-up of the image forming system, execution of the threshold value setting process of FIG. 16 can be omitted. Instead of holding the tables TBL1 and TBL2, information about the tables TBL1, TBL2 can be held in the form of arithmetic formulae or the like. Instead of assigning time stamps to variables in step S205 of FIG. 12, etc., it is possible to use a time measured by a timer provided for each variable.

In this embodiment, the standard sheet interval time information is used. Alternatively, information about processing number of sheets per unit time or printing speed or sheet conveyance speed can be used. When the standard sheet interval time information is required, the information about the processing number of sheets or printing speed or sheet conveyance speed can be converted by the CPU 100 into the standard sheet interval time information.

According to this embodiment, if determined in the press mode setting process that the folding priority mode has not been set in the folding mode in the sheet information J1, "press" is set to the press mode in sheet bundle information J3 when the number of sheets of the sheet bundle K is equal to or larger than the threshold value R (e.g. 3). When the number of sheets of the bundle is less than the threshold value R, "press-less" is set to the press mode. In other words, the necessity or unnecessity of "press" can be determined according to the number of sheets, while taking account of the productivity.

If determined in the press mode setting process that the folding priority mode has been set in the folding mode in the sheet information J1, a predetermined number of sheets, Nx (e.g., 10), is set in such a manner that no waiting time is generated in the image forming apparatus 1 even when the press mode is set to "press," if the number of sheets of the sheet bundle is less than the predetermined number of sheets, Nx. As a result, the productivity can be avoided from being lowered.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-149327, filed Jul. 18, 2013, which is hereby incorporated by reference herein in its entirety.

What is claimed is:

1. A sheet processing apparatus comprising:

a stacking unit configured to stack sheets thereon to form a sheet bundle;

a folding unit configured to fold the sheet bundle formed by said stacking unit;

a press unit configured to perform press processing to press a folded part of the sheet bundle folded by said folding unit, from a direction perpendicular to a sheet surface of the sheet bundle;

a setting unit, through which an operator manually sets a press mode that causes the press unit to perform the press processing; and a control unit configured to control said press unit:

in a case where the press mode is set, to perform the press processing on the folded sheet bundle regardless of the number of sheets of the sheet bundle; and in a case where the press mode is not set, to not perform the press processing when the number of the sheets of the sheet bundle is less than a predetermined number, and to perform the press processing when the number of sheets of the sheet bundle is equal to or larger than the predetermined number.

2. The sheet processing apparatus according to claim 1, wherein the predetermined number is set according to a size of sheets of the sheet bundle by an image forming apparatus that supplies the sheets to said stacking unit.

3. The sheet processing apparatus according to claim 2, further including:

a holding unit configured to hold information that specifies a relation between the sheet size and the predetermined number, wherein said control unit sets the predetermined number, while referring to the information held by said holding unit.

4. The sheet processing apparatus according to claim 2, wherein the predetermined number is a fixed value.

5. The sheet processing apparatus according to claim 1, wherein in a case where a press processing time required for said press unit to perform the press pressing on the sheet bundle is larger than a stack processing time required for said stacking unit to form the sheet bundle, said control unit is configured to send, to an image forming apparatus that supplies the sheets to said stacking unit, an instruction to provide a time interval in image formation according to a difference between the press processing time and the stack processing time.

6. The sheet processing apparatus according to claim 1, further comprising:

a flattening unit configured to perform a flattening processing to flatten the folded part of the sheet bundle by the folded part of the sheet bundle pressed from a direction parallel to the sheet surface of the sheet bundle, wherein in a case where said flattening unit is to perform the flattening processing, the flattening processing is performed concurrently with the press processing performed by said press unit.

7. A sheet processing apparatus comprising:

a stacking unit configured to stack sheets thereon to form a sheet bundle;

a folding unit configured to fold the sheet bundle formed by said stacking unit;

a press unit configured to perform press processing to press a folded part of the sheet bundle folded by said folding unit;

a setting unit configured to set an operation mode of said press unit; and a control unit configured to:

in a case where the operation mode of said press unit is set to a predetermined mode by said setting unit, control said press unit to perform the press processing on the folded sheet bundle;

in a case where the operation mode of said press unit is set to a mode other than the predetermined mode by said setting unit, determine based on the number of sheets of the sheet bundle whether the press processing is to be performed on the sheet bundle and control said press unit accordingly; and in a case where the predetermined mode is not set, determine that the press processing is to be performed on the sheet bundle, when the number of sheets of the sheet bundle is equal to or larger than a threshold value set according to a size of sheets of the sheet bundle, and determine that the press processing is not to be performed on the sheet bundle, when the number of sheets of the sheet bundle is less than the threshold value, wherein the threshold value is determined based on the number of sheets of the sheet bundle at which a stack processing time required for said stacking unit to form the sheet bundle does not become larger than a press processing time required for said press unit to perform press pressing on the sheet bundle.

8. The sheet processing apparatus according to claim 7, wherein the stack processing time is determined based on time information that specifies a time required by the image forming apparatus to form an image on one sheet.

9. The sheet processing apparatus according to claim 7, wherein the press processing time is determined based on a sheet size and the number of sheets of the sheet bundle.

10. A sheet processing apparatus comprising:

a stacking unit configured to stack sheets thereon to form a sheet bundle;

a folding unit configured to fold the sheet bundle formed by said stacking unit;

a press unit configured to perform press processing to press a folded part of the sheet bundle folded by said folding unit;

a setting unit configured to set an operation mode of said press unit; and a control unit configured to:

in a case where the operation mode of said press unit is set to a predetermined mode by said setting unit, control said press unit to perform the press processing on the folded sheet bundle;

in a case where the operation mode of said press unit is set to a mode other than the predetermined mode by said setting unit, determine based on the number of sheets of the sheet bundle whether the press processing is to be performed on the sheet bundle and control said press unit accordingly; and in a case where a press processing time required for said press unit to perform press pressing on the sheet bundle is larger than a stack processing time required for said stacking unit to form the sheet bundle, send, to an image forming apparatus that supplies the sheets to said stacking unit, an instruction to provide a time interval in image formation according to a difference between the press processing time and the stack processing time.

11. An image forming system comprising:

an image forming unit configured to perform image formation on sheets;

a stacking unit configured to stack the sheets formed with images by said image forming unit and to form a sheet bundle;

a folding unit configured to fold the sheet bundle formed by said stacking unit;

a press unit configured to perform press processing to press a folded part of the sheet bundle folded by said folding unit, from a direction perpendicular to a sheet surface of the sheet bundle;

a setting unit, through which an operator manually sets a press mode that causes said press unit to perform the press processing; and a control unit configured to control said press unit:

in a case where the press mode is set, to perform the press processing on the folded sheet bundle regardless of the number of sheets of the sheet bundle; and in a case where the press mode is not set, to not perform the press processing when the number of the sheets of the sheet bundle is less than a predetermined number, and to perform the press processing when the number of sheets of the sheet bundle is equal to or larger than the predetermined number.

* * * * *